United States Patent [19]

Edgar et al.

[11] 3,958,370

[45] May 25, 1976

[54] SINGLE SLIDE GRINDING MACHINE WITH MEANS FOR SELECTIVELY PRODUCING A RECIPROCATION OF SAID SLIDE

[75] Inventors: Hugh T. Edgar, Charlestown, N.H.; John W. Lovely, Springfield, Vt.

[73] Assignee: Bryant Grinder Corporation, Springfield, Vt.

[22] Filed: June 16, 1975

[21] Appl. No.: 587,081

Related U.S. Application Data

[62] Division of Ser. No. 464,917, April 29, 1974.

[52] U.S. Cl. ..... 51/165.89

[51] Int. Cl.[2] ..... B24B 51/00

[58] Field of Search..... 51/34 C, 45, 56, 59 R, 51/60, 64, 84 R, 91 R, 92 R, 122, 165.89

[56] References Cited

UNITED STATES PATENTS

| | | | |
|---|---|---|---|
| 2,675,651 | 4/1954 | Rauch | 51/45 |
| 3,146,551 | 9/1964 | Carlsen | 51/34 C |

*Primary Examiner*—Al Lawrence Smith
*Assistant Examiner*—Nicholas P. Godici
*Attorney, Agent, or Firm*—Thomas N. Young

[57] ABSTRACT

A single-slide, mechanically and electrically programmed grinding machine comprising a rigid enclosed base, a fixed workhead assembly on the base, a pair of parallel slidebars mounted on the base, and a wheelslide assembly mounted on the base for longitudinal displacement thereover. Longitudinal wheelslide displacement is mechanically controlled by a motor-driven cam bearing against a spring-biased lever pivoted to the base and connected to the wheelslide via a rod. Lateral feed is independently electrically controlled by a motor-driven nut and screw shaft assembly which angularly displaces the wheelslide assembly relative to one of the slidebars and about the centerline of the other slidebar. An eccentric and variable-position spacer is provided for reciprocating the wheelslide during a grind operation. A thermally-stable base configuration is disclosed. Part load and unload apparatus, all mechanically programmed, are also disclosed.

5 Claims, 45 Drawing Figures

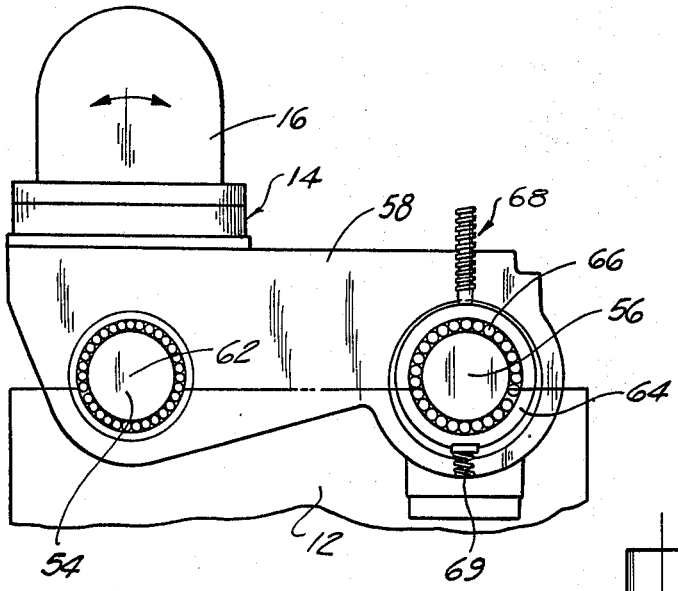
FIG. 3
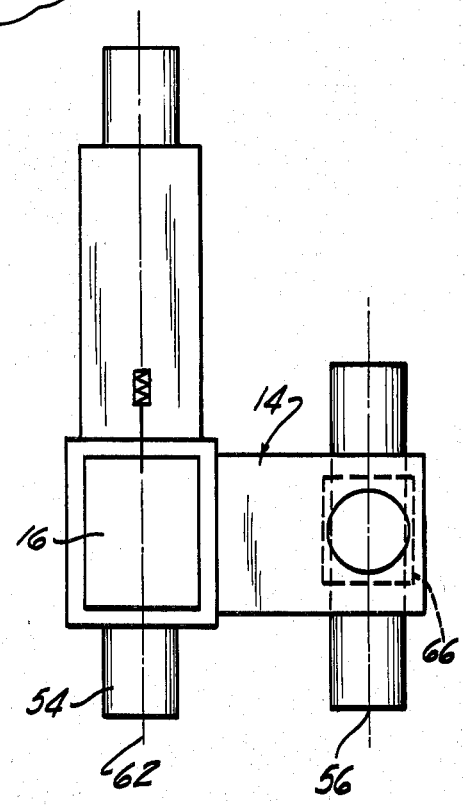
FIG. 4
FIG. 5
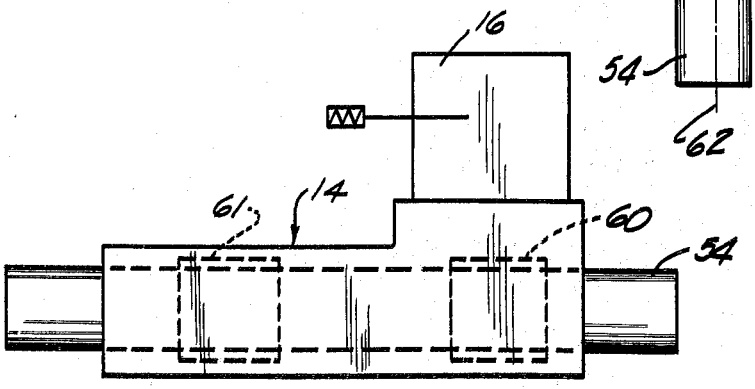

FIG. 10
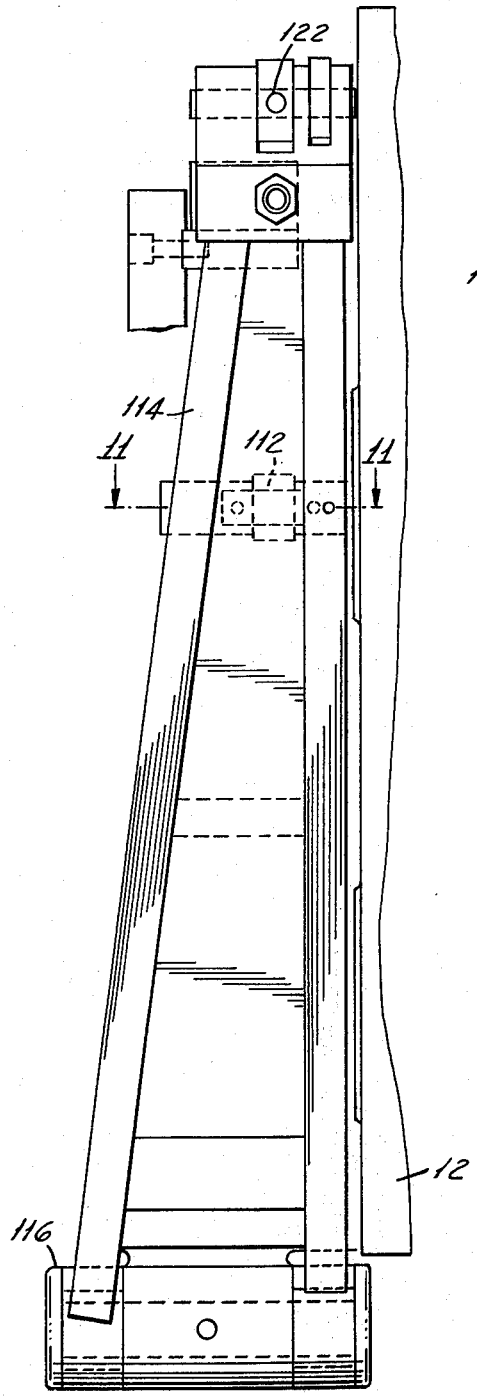
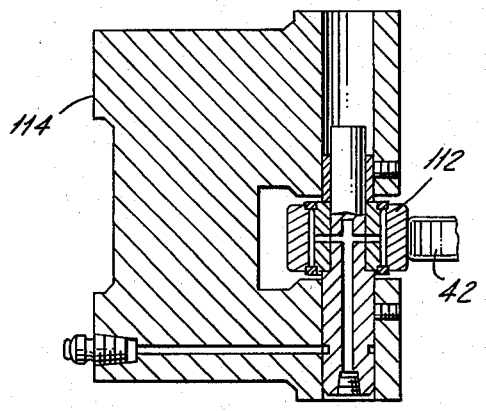
FIG. 11

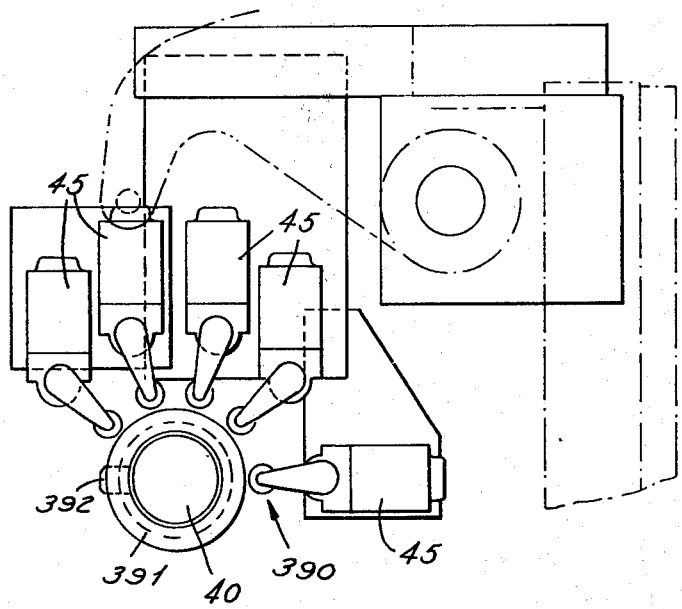
FIG. 24
FIG. 25
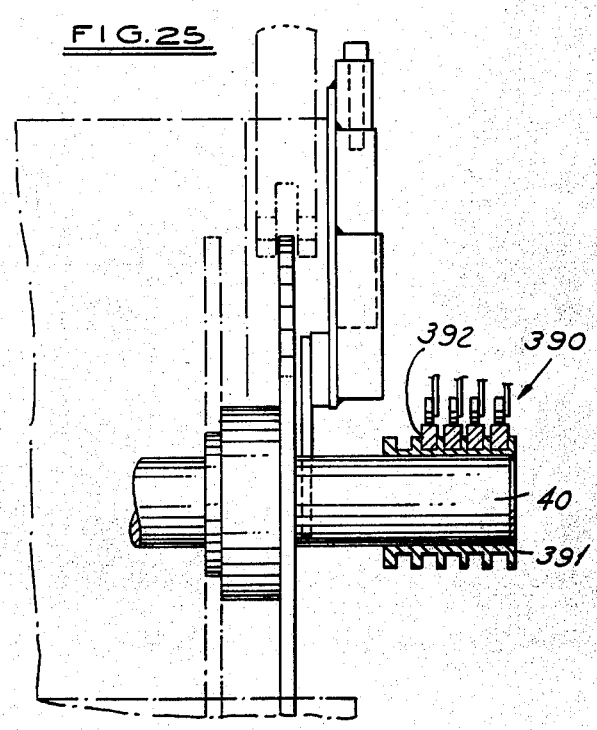

526
552
590
578
550
592
588
490
582
584
580
586
596
594
28

SINGLE SLIDE GRINDING MACHINE WITH MEANS FOR SELECTIVELY PRODUCING A RECIPROCATION OF SAID SLIDE

This is a division of application Ser. No. 464,917, filed Apr. 29, 1974.

INTRODUCTION

This invention relates to metal working machinery such as internal grinding machines and particularly to a metal working machine which is characterized by high mechanical stiffness with resulting high accuracy, such stiffness being accomplished in part by the use of a single slide mechanism to produce both longitudinal and lateral displacement between a workpiece and the metal working tool or wheel.

BACKGROUND OF THE INVENTION

Industrial metal working machinery is widely employed to accomplish such precision operations as internal grinding wherein a smoothly finished surface worked to close tolerances is required. Such machinery typically comprises a workhead having a workholder or chuck and a wheelhead carrying the metal working tool; e.g. a grinder wheel. In addition, the machinery typically comprises first and second slide assemblies which provide the necessary longitudinal and lateral displacement capabilities between the work holder and the wheel spindle. As is well known, the longitudinal displacement is taken along an axis aligned with the workholder and wheelhead axes whereas lateral displacement is taken along an axis perpendicular to the wheel spindle axis and permits the wheel to be fed radially into engagement with the workpiece. An example of a grinder machine having two slide assemblies is shown in U.S. Pat. No. 2,952,949 issued Sept. 20, 1969 to Paul Maker.

One of the inherent difficulties or problems with a machine having two slides is the realization of high machine stiffness or rigidity under load. The lateral slide introduces position variations by virtue of its mechanical compliance. As is well known, compliance in bearings and other mechanical components which are involved in the implementation of the slide assembly can be minimized by the use of complex and precision parts, preloading and other approaches, but all such solutions add cost and complexity to the machine. Accordingly, a machine having two slide assemblies is typically less stiff than a single slide machine.

BRIEF SUMMARY OF THE INVENTION

In accordance with the invention a metal working machine is provided which is characterized by high performance stiffness while having both longitudinal and lateral feed capabilities. In general, this is accomplished by means of a combination of a base, and a single slide for mounting an assembly such as a wheelslide assembly on the base for longitudinal sliding displacement, and by providing additional independent means for rotating the slide assembly about an axis which is coincident with or parallel to the longitudinal slide axis but which is remote from the wheelhead axis thereby to cause or produce a lateral feed displacement of the wheelhead relative to the workpiece. The mechanism by which the rotational displacement of the slide assembly is effected may, for example, involve rotational bearings which, as is well known to those skilled in the art, may be made in such a fashion as to exhibit extremely high lateral stiffness.

In accordance with the invention and according to a preferred form thereof, a metal working machine is provided which includes a wheelslide assembly mounted for longitudinal sliding displacement on a base, a mechanical cam-lever programming system for programming longitudinal displacements of the wheelslide assembly relative to the base and a separate and independent program controlled means for effecting lateral feed in precise amounts and at selected times. In this fashion the advantages of positive drive and simple adjustment are provided for all longitudinal wheelslide movements as well as selected other operations such as part load and unload operations and dresser control while readily reprogrammable independent means are provided for controlling lateral feed. This is of extraordinary advantage in an internal grinder machine where lateral feed is varied to account for wheel wear and other factors and hence is subject to short duration variation while longitudinal displacement is typically fixed for a long production run related to a given part design and does not change at frequent intervals. In the preferred form, the lateral feed system comprises a digital programming system for pre-establishing a plurality of lateral feed end points which can be sequentially input to a digital stepper motor control. The control causes rotation of a motor which drives a travelling nut via a worm gear drive assembly. The nut travels over a threaded shaft which bears against a fixed sleeve on one of two slide bars and is also connected to the wheelslide. Thus, travel of the nut causes displacement of the wheelslide about the other slidebar and, thus, produces lateral displacement of the wheel spindle.

In accordance with the invention a novel mechanism is provided for imparting an oscillatory reciprocation to a slide assembly such as a wheelslide mounted for longitudinal sliding displacement on a base, such mechanism having the capability of instantaneous actuation irrespective of the oscillator eccentric output of slide assembly position relative to the base and having the further advantage of variable control, i.e., a fixed oscillator such as an eccentric cam may be provided while at the same time varying degrees of axial travel may be programmed by a simple mechanical adjustment. In general, this is accomplished by means of an oscillator drive device such as an eccentric cam mounted for rotation on the base of a selectively actuated device for controllably and instantaneously inserting a spacer member between the oscillator and the slide assembly in various angular positions to accomplish various degrees of reciprocation transfer from the cam to the slide assembly.

In accordance with a further feature of the invention a novel system of speed control and longitudinal displacement reversal is provided such that long-stroke, slow-rate reciprocating maneuvers such as those associated with a new wheel dress operation may be provided under ideal circumstances of drive control while other operations such as program cam shaft rotation may be carried out under the control of a high acceleration motor. In general this is accomplished by the provisions of two motors of varying electrical characteristics and varying output characteristics and a system of clutches and belts for selectively actuating the program mechanism associated with longitudinal wheelslide movements from one or both motors depending upon the particular operation to be carried out. In a specific example hereinafter described in greater detail one of the motors is a D.C. motor while the other is an A.C. synchronous motor which is not susceptible to simple speed control. The two motors are constantly energized thereby to be constantly rotating. However, a system of clutches and belts is employed to selectively connect one or the other of the motors to a programming cam shaft which control wheelslide displacement in the axial or longitudinal direction. To perform a new wheel dress operation which involves a long stroke reciprocation of the wheelslide relative to a diamond dresser the motors are actuated in such a way as to turn in opposite directions and are then intermittently clutched into the control of the program cam shaft to reverse the shaft and reciprocate the wheelslide assembly for a predetermined dress step.

In accordance with a further feature of the invention an improved base design is provided to contribute to and enhance the stiffness and thermal stability of the machine. In general, this is accomplished by providing a base having a rigid enclosure and defining a platform on which various precision parts such as a workhead and wheelslide assembly may be mounted and further by providing a coolant collection pan which is mounted on the support pedestals in vertically spaced relationship to the base platform thereby to minimize thermal transfer from the coolant to the base itself.

Various other additional features and advantages of the invention will be best understood from a reading of the following specification.

BRIEF DESCRIPTION OF THE DRAWINGS

FIG. 3 is a schematic drawing of a wheelslide housing and a slidebar arrangement for the single slide machine of FIGS. 1 and 2;

FIG. 4 is a schematic plan view of the wheelslide assembly and slidebar;

FIG. 5 is a schematic side view of the wheelslide and slidebar arrangement;

FIG. 10 is an end view of the wheelslide displacement lever;

FIG. 11 is a detail of the wheelslide displacement lever showing the cam roller;

FIG. 24 is an end view of the programming cam showing the relationship of various limit switches thereto;

FIG. 25 is a side view of the cam shaft and limit switch assembly;

DETAILED DESCRIPTION OF THE ILLUSTRATIVE EMBODIMENT

General Description

Figure 1:
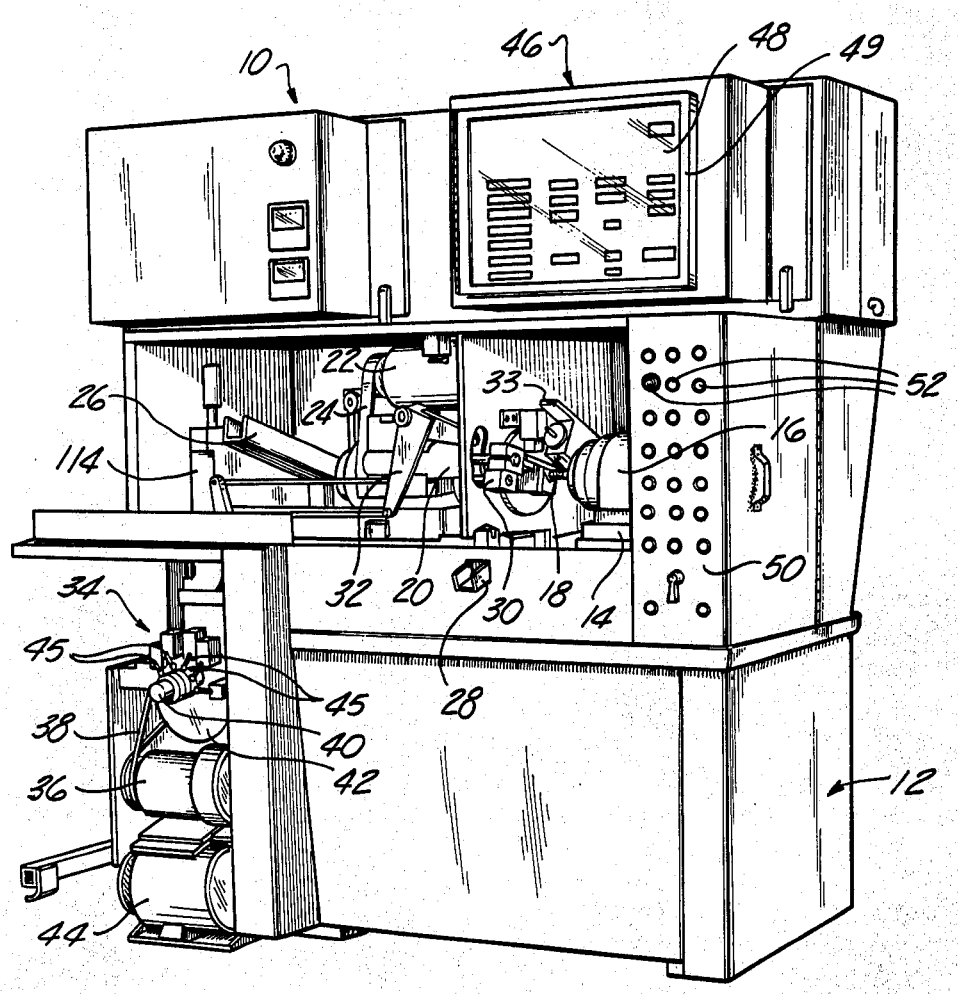
FIG. 1 is a perspective view of an internal grinding machine embodying the various features of the invention.

Referring now to FIG. 1 there is shown an industrial grinder machine 10 of the type specifically adapted to bore grind high production long run workpieces such as valve lifter bodies, universal joint bearing cups, and the like. The grinder machine comprises a rigid, enclosed base 12 which supports a slidable wheelhead assembly 14 including a wheelhead or drive motor 16 for turning a wheel spindle 18. Base 12 supports a workhead assembly 20 which is rigidly and substantially immovably mounted on the base 12. The workhead assembly comprises a workholder or chuck (FIGS. 40, 41, and 42) for supporting a workpiece during the metal working operation. The workhead further comprises a drive motor 22 which is connected by way of a belt 24 to the chuck assembly for rotating the workpiece at a high speed during the metal working operation. The wheelslide assembly 14 is longitudinally slidably displaceable relative to the base 12 along the spindle axis so as to bring the wheel to the workpiece in the chuck. In addition, the assembly 14 is tiltable relative to the base to effect a lateral spindle feed into the workpiece.

Figures 35, 36:
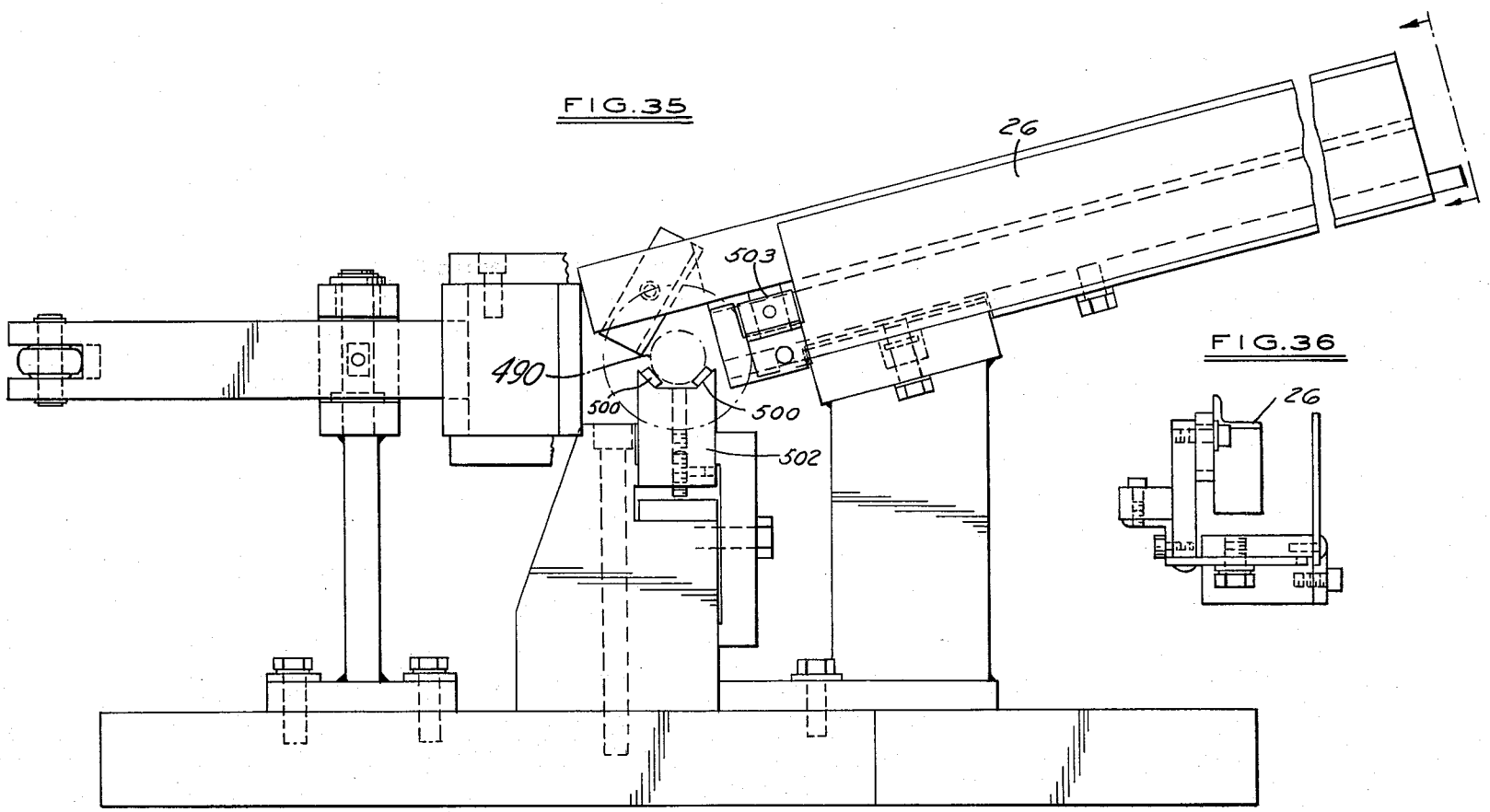
FIG. 35 is a side view of a part loader.
FIG. 36 is a detail of the part loader.
Figure 37:
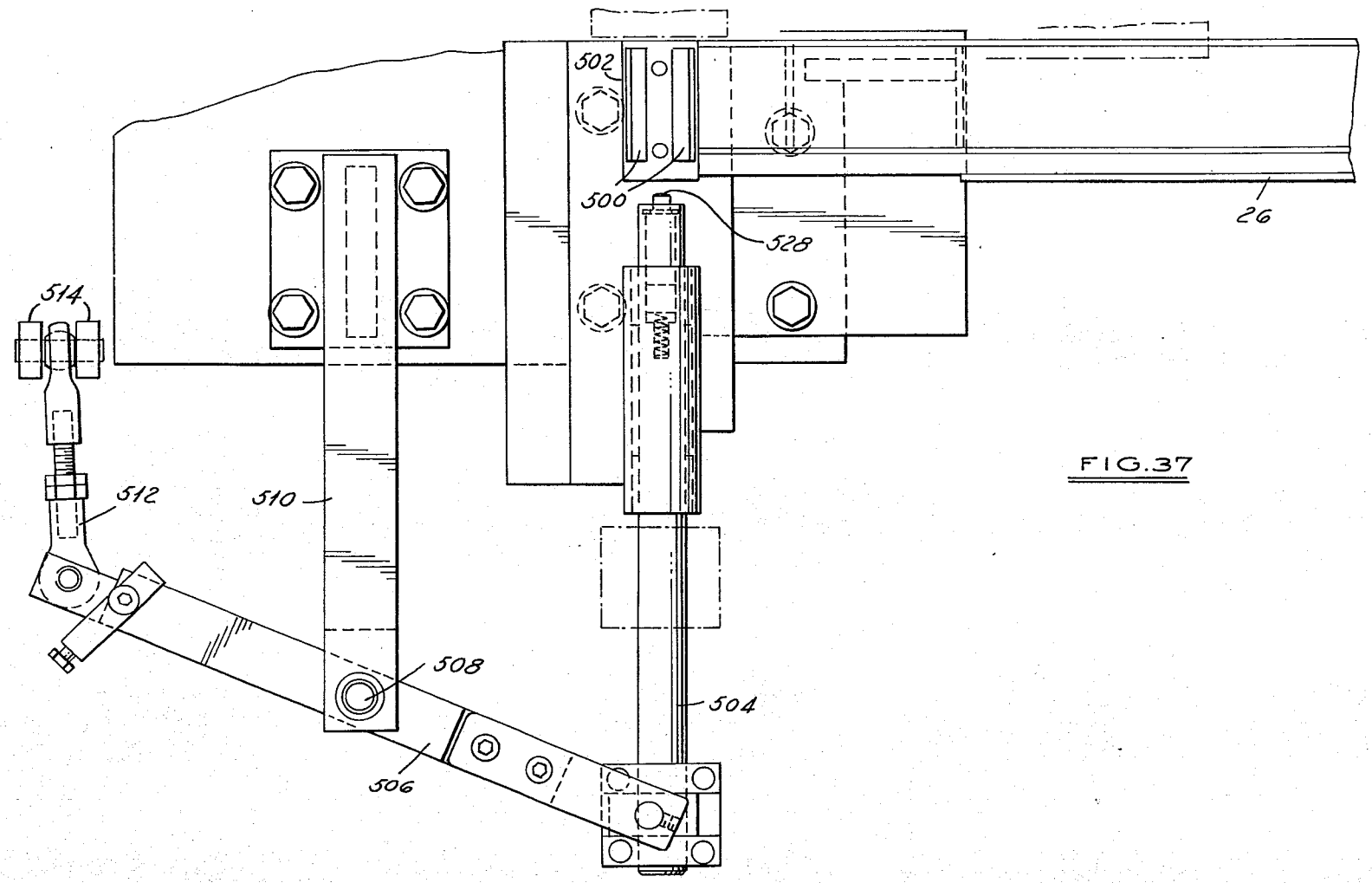
FIG. 37 is a plan view of the part loader assembly.

As hereinafter described in greater detail with reference to FIGS. 35 through 37, workpieces or parts 490 are loaded into the machine 10 for performance of the internal grind operation thereon by way of the load chute 26 and a loader mechanism to be described, it being understood that such loader mechanism is merely representative of various loader mechanisms which may be employed with the machine 10. As also described in greater detail with specific reference to FIGS. 38 and 39, the workpieces or parts after having been ground are released from the chuck and are placed in a discharge chute 28 from which the parts may be received and stacked or assembled with other finished parts as desired. An unloader arm 30 is partially shown in FIG. 1 to perform the operations of removing the parts from the chuck and transferring them to the discharge chute 28.

The operations of the loader mechanism and the unloader mechanism including arm 30 and the control lever 32, the actuation of a wheel dresser 33 (shown in FIG. 1 in the raised or withdrawn position) as well as the longitudinal displacements of the wheelhead assembly 14 relative to the base 12 are all programmed by a mechanical programming mechanism 34 shown at the lower left end of the machine 10 in FIG. 1. The program mechanism comprises an A.C. synchronous motor 36 which is connected by way of a belt drive and clutch mechanism hereinafter described to intermittently rotate a program cam shaft 40 on which are mounted a series of program cams such as 42. The programming mechanism 34 further comprises a variable speed D.C. motor 44 which is also connected by means of a belt drive and clutch mechanism to the cam shaft 40, the mechanism being such as to select one or the other of the two motors for driving the cam shaft 40 during machine operations. A plurality of adjustable limit switches 45 are mounted on the base adjacent the cam shaft 40 for establishing the various mechanical limits at which the programmed operations are to terminate.

The sequence of cam shaft rotation initiations is controlled by means of a solid state sequencer 46 which is disposed on top of the machine 10 and which comprises a digital display panel 48 having an access door 49 with a transparent glass face. The details of the solid state sequencer are partially disclosed herein and are more fully disclosed in the copending application Ser. No. 465,334 now U.S. Pat. No. 3,939,453 filed concurrently herewith in the name of Roger L. Schroeder and entitled "Diagnostic System for Machine Sequence Controller". Machine 10 further comprises an operator control panel 50 having pushbuttons and other signaling devices 52 for initiating various machine functions such as turning on the wheelhead motor 16, the workhead motor 22, and the dresser motor 33, initiating a cycle of operations, establishing coolant flow, air conditioning and etc. It is to be understood that the machine 10 typically comprises such peripheral devices as air conditioning and coolant treating as may be familiar and apparent to those skilled in the art, such devices forming no part of the present invention and not being described herein. In brief, the devices 52 initiate various operations and establish various necessary conditions whereas sequencer 46 controls the sequence or order of machine operations to be carried out. Mechanical programming mechanism 34 establishes the mechanical limits of displacement and the drive necessary to produce mechanical displacements of various parts.

It will be understood that while the various features of the invention will be described with specific reference to an internal grinding machine for performing specific operations on specific parts, the applicability of the invention and the various aspects thereof to various other types of machinery for metal working operations and the like will be apparent to those skilled in the art and hence this description is not to be construed in a limiting sense except as may be explicitly set forth herein.

Single Slide Mounting and Lateral Feed

As previously described one of the principal features of the invention is the precision high load grinding capability and extraordinary machine stiffness which result from the use of a single machine slide mechanism to provide relative displacement between the critical metal working components and the workpieces. This differs from the typical metal working machine which involves at least two slide mechanisms typically mounted at right angles to one another so as to provide both longitudinal and lateral displacement capabilities of the wheelhead or spindle 18 relative to the workhead 20; i.e., longitudinal displacement being necessary to enter and withdraw from the part and lateral displacement being necessary to move into engagement with the interior side wall of the part and to compensate for wheel wear.

Figure 2:
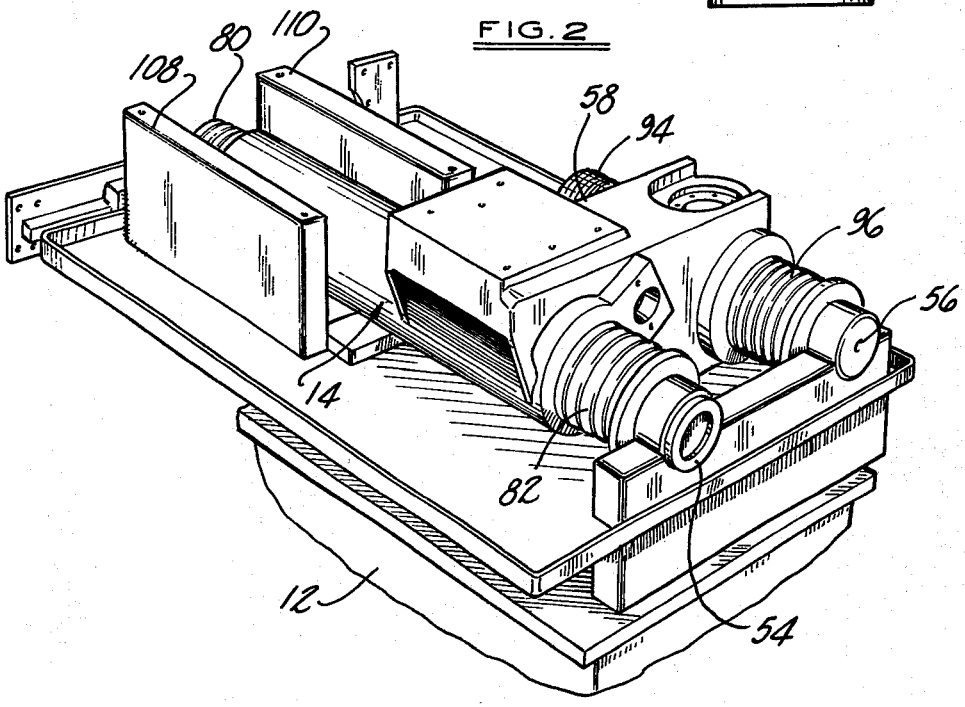
FIG. 2 is a perspective view of a base slide bar and wheelslide assembly in a particularly assembled state.

Looking first to FIGS. 2 through 5, a relatively simplified explanation of the wheelslide, slidebars, and lateral feed mechanism will be given. In FIGS. 2 and 3 the base 12 is shown to rigidly support a horizontal front slidebar 54 of polished high-grade steel having a circular cross-section. Base 12 further supports in parallel spaced relation to the front bar 54 a rear slidebar 56 of similar configuration but of a shorter length as best shown in FIGS. 2 and 4. The wheelhead assembly 14 comprises a wheelslide housing 58 of heavy cast and machined metal mounted on the slidebars 54 and 56 by way of ball bearing assemblies 60, 61 and 66. Bearing assemblies 60 and 61 are widely longitudinally spaced along bar 54 as shown in FIG. 5 with bearing 60 substantially directly under the wheelhead 16 and with bearing assembly 66 around slidebar 56 and laterally opposite the bearing 60. Bearings 60, 61 and 66 permit the heavy wheelhead assembly 14 to be moved longitudinally along an axis parallel to the centerlines of the slidebars 54 and 56 to control the longitudinal feed of the wheel spindle 18 relative to the stationary workhead 20 shown in FIG. 1. Bearings 60 and 61 further permit the wheelhead assembly 14 to be rotated about the axis defined by the centerline 62 of slidebar 54, such rotation being produced by the lateral feed control system hereinafter described in detail with reference to FIGS. 8, 9 and 15 through 20.

By way of introductory description to the lateral feed mechanism, FIG. 3 shows that the slidebar 56 directly supports a rigid sleeve 64 which achieves a longitudinal sliding freedom from bar 56 by means of the bearing set 66. In addition, the wheelslide housing 58 in the area of the slidebar 56 is bored out to provide a substantial gap around the sleeve 64 and is mechanically interconnected therewith by means of a motor-driven extensible power assembly schematically shown at 68 and a compression spring 69. By way of the power assembly 68 the wheelslide housing 58 may be raised or lowered relative to the centerline of the slidebar 56 thus to produce rotation about the centerline 62 of slidebar 54. The result is a lateral feed of the wheelhead spindle 18 at a radius measured from the centerline 62 of the front slidebar 54 to the centerline of the wheel spindle 18. Thus, lateral feed is accomplished without the need for a second slide axis with the typically consequential introducton of lateral slide compliance along therewith.

Workslide Displacement-Longitudinal

Looking now to FIGS. 6, 7, 8, and 10 through 14, the major components of the apparatus which provide the facility for and control of the longitudinal or axial displacement of the wheelslide assembly 14 relative to the base 12 will be described.

Figure 6:
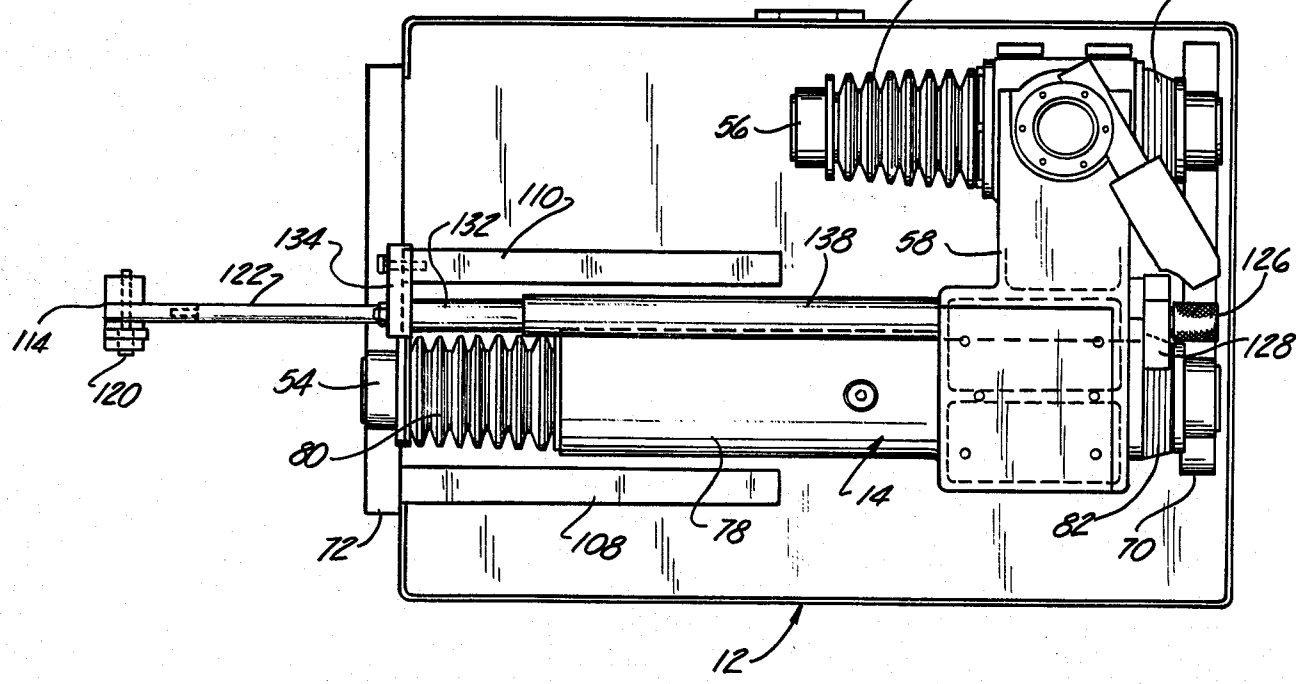
FIG. 6 is a plan view of the base, slidebar and wheelslide assembly.
Figure 7:
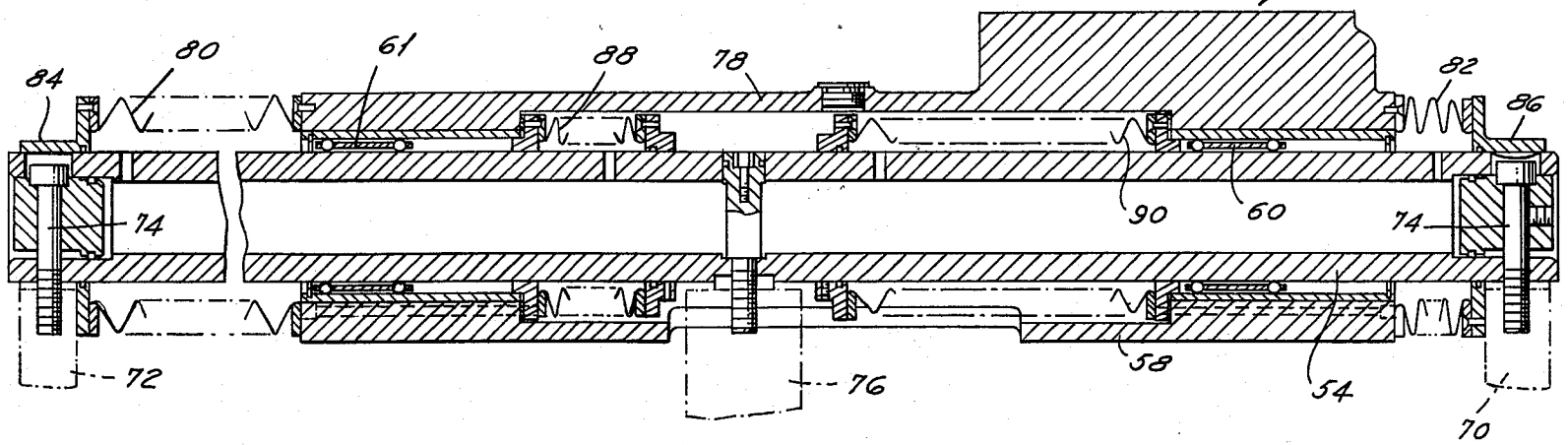
FIG. 7 is a sectional view of the first or front slidebar showing the relationship of the wheelslide housing thereto.

In FIGS. 6 and 7 the base 12 is shown to comprise a pair of spaced parallel rigid support members 70 and 72 which are notched out to receive the opposite ends of the front slidebar 54. The slidebar 54 is rigidly and non-rotatively secured to the support members 70 and 72 by means of machine screws 74 shown in FIG. 7. A central support 76 may also be utilized for additional rigidity in the support of the bar 54. The wheelslide assembly 14 comprises the housing 58 having an elongate tubular portion 78 which telescopes over the slidebar 54 along a substantial portion of the length thereof. Ball bearing assemblies 60 and 61 as shown in spaced relationship along the bar 54 in FIG. 7 on opposite sides of support 76 just as they are schematically represented in FIG. 4. The wheelslide housing 58 is longitudinally shorter than the bar 54 and flexible boots 80 and 82 are connected between the ends of the housing 54 and the stops 84 and 86 on the slidebar 54 to prevent the ingestion of foreign contaminates by the bearings 60 and 61. Internal boots 88 and 90 may also be provided to isolate the bearing surface of the bar with reference to the center support 76.

Figure 8:
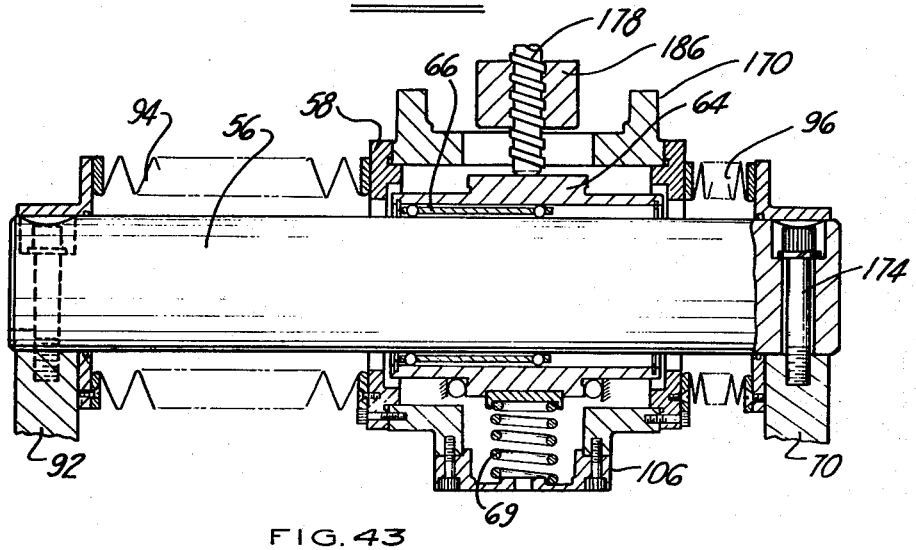
FIG. 8 is a sectional view showing the details of the rear slidebar and indicating the mechanical details of the wheelslide assembly in relation thereto.
Figure 17:
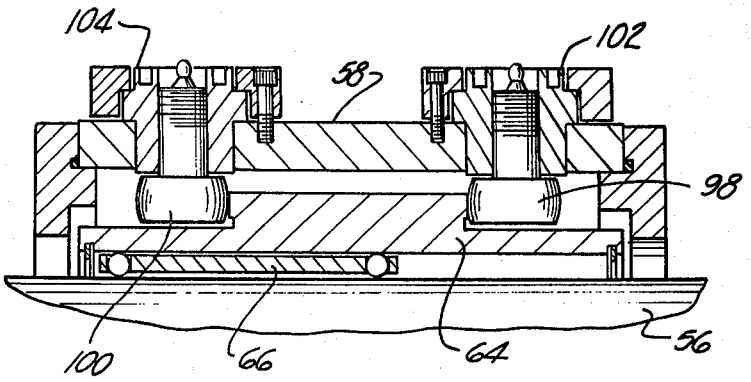
FIG. 17 is a sectional view of a detail of the mechanical interconnection between the wheelslide housing and the rear slidebar bearing.

The rear bar 56, as best shown in FIG. 8, is rigidly supported between spaced parallel support members 70 and 92 which are secured to the base 12 for stability and rigidity. Again, mounting screws 174 secure the bar to the base in a non-shifting and non-rotatable fashion. Wheelslide housing 58 surrounds the bar 56 but is not in direct mechanical contact therewith except through the screw shaft assembly previously described with reference to FIG. 3. Again the wheelslide housing 58, as it surrounds the bar 56, is of shorter longitudinal length than the bar and is provided with boots 94 and 96 to prevent the ingestion of foreign materials into the sliding area of the bearing 66. The sleeve 64, as best shown in FIG. 8, is mounted directly on the bearing assembly 66 for longitudinal sliding displacement over the bar 56. Note that substantial radial clearance exists between the sleeve 64 and the surrounding portion of the wheelslide housing 58. As schematically represented in FIG. 8 and as represented in detail in FIG. 17, the sleeve 64 has formed thereon a central section of increased radial thickness so as to produce a pair of opposing peripheral shoulders against which preloaded rollers bear to prevent any axial shifting of the wheelslide housing 58 relative to the sleeve 64 during axial longitudinal displacement of the wheelhead assembly 14. As best shown in FIG. 17 the rollers 98 and 100 are eccentrically mounted in rotatable bushings 102 and 104 thereof respectively such that when fully secured into the wheelslide housing by the mechanism illustrated in FIG. 7 opposing loads are applied to the sleeve 64.

From the combination of FIGS. 3 and 8 it is apparent that the wheelslide housing 58 is free to rotate between fixed limits about the centerline of the long slidebar 54 and, hence, in the absence of the support provided by the power assembly 68, could drop downwardly relative to the fixed position slidebar 56, shown in FIG. 8. Thus, it is clear that the mechanical force of the power assembly 68 is such as to lift the wheelslide housing 58 against the gravity load of the housing itself and further against the compressive forces of the compression spring 69 which is disposed radially between the sleeve 64 and the cup-shaped projection 106 of the wheelslide housing 58 as shown in FIG. 8.

From the foregoing it is apparent that the wheelhead assembly 14 including the wheelslide housing 58 is free to displace longitudinally over the base 12 by sliding over the rigid slidebars 54 and 56, the extent of travel being typically a matter of several inches in a commercial internal grinding machine. Since the workhead 20 is mounted on the fixed bed rails 108 and 110 which are disposed in parallel spaced relationship straddling the front slidebar 54 as best shown in FIG. 6, relative displacement of the wheelslide housing 58 is such as to move the wheel spindle a matter of approximately 4 to 6 inches of maximum travel relative to the workpiece when mounted in the workhead 20.

To produce longitudinal wheelslide displacement, the mechanical programming apparatus 34 comprises motors 36 and 44 for selectively and intermittently rotating cam shaft 40. The cam 42 on cam shaft 40 bears against a cam follower roller 112 on a wheelslide control lever 114, the lower end of which is pivotally mounted on the base 12 by means of a needle bearing pivot assembly 116 shown in FIGS. 10 and 12. Thus, the lever 114 pivots back and forth relative to the base 12 according to the peripheral contour of the cam 42. The upper or free end of the lever 114 is connected by pivot pin 120 to a rigid wheelslide control rod 122 which extends longitudinally and substantially horizontally from the upper free end of the lever 114 across the top of the base 12 and through to the opposite side of the wheelslide housing 58 as best shown in FIG. 6. Rod 122 is terminated on the right-hand end thereof as shown in FIG. 13 in a threaded portion 124 which receives a knurled adjustment knob 126 of enlarged diameter. Knob 126 bears against and is rotatable relative to block 128 which is mounted on the wheelslide housing 58. Screw 128 also bears against a wheelslide stop 130 which is mounted on the base 12 as shown in FIG. 13 so as to limit the longitudinal travel in the right-hand direction in FIG. 13 of the wheelslide relative to the base.

Rod 122 extends through a first or inner tube 132 which is non-rotatably welded to a bracket 134 which is in turn fixed to the base 12 so as to receive and support one end of a compression spring 136. The other end of the spring 136 bears against the block 128. An outer tube 138 surrounds the spring 136 for protective purposes and is held in place by means of block 128.

Figure 12:
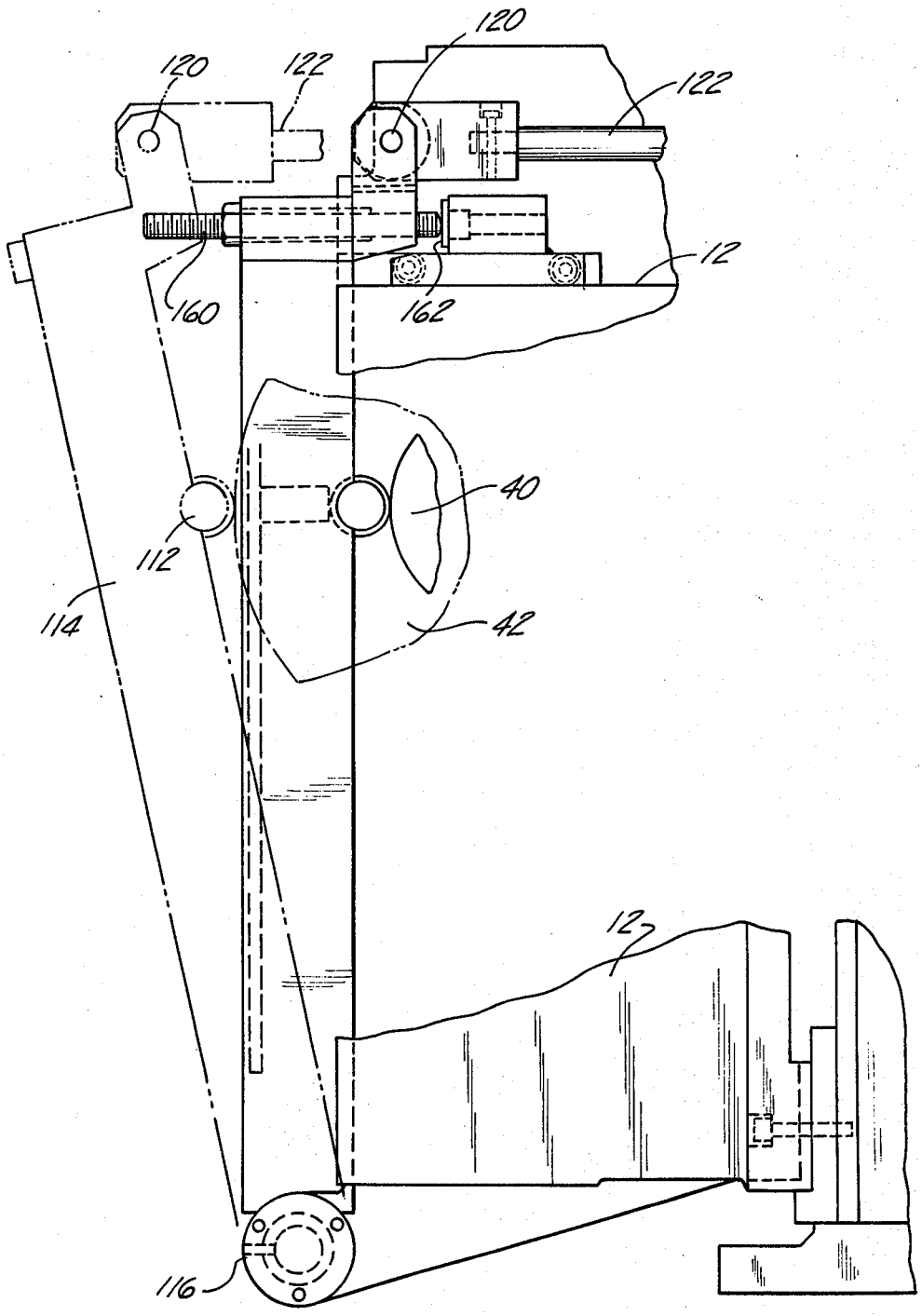
FIG. 12 is a side view of the wheelslide displacement lever and cam.
Figure 13:
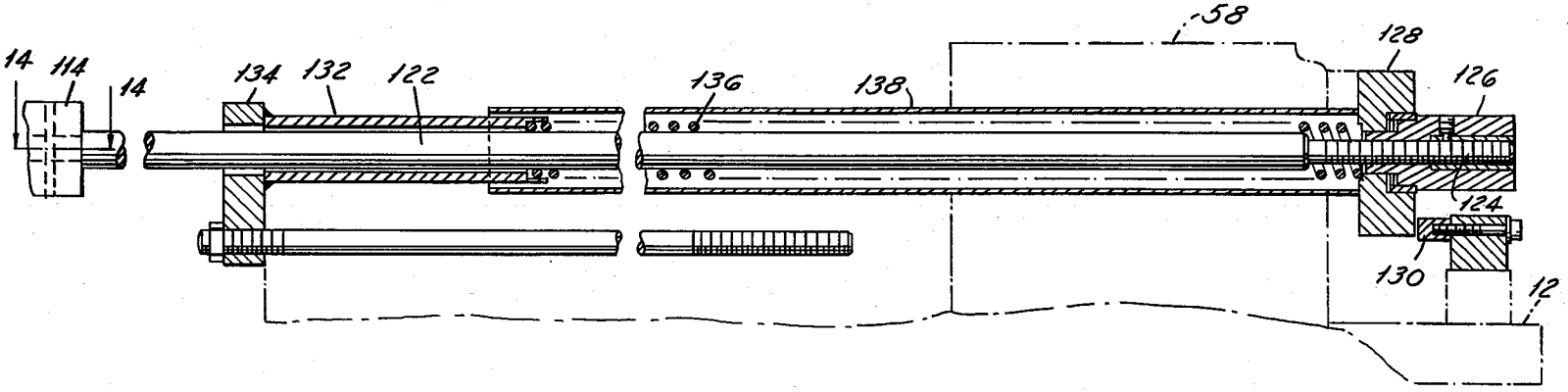
FIG. 13 is a side view in section of the spring bias apparatus interconnecting the wheelslide assembly and the grinder machine base.

Since the spring 136 is compressed and held between the bed (via tube 132 and bracket 134) and the wheelslide assembly 58 (via block 128), the spring force urges the wheelslide longitudinally to the right as seen in FIGS. 12 and 13. The spring force thus also holds the lever 114 against the cam 42 so the roller 112 faithfully follows the cam contour. At a point of minimum cam radius, the wheelslide 58 moves to the right unit block 128 contacts limit stop 130. Movement of the left as seen in FIGS. 12 and 13 is caused as the cam drives the lever 114 away from the stop 162 toward the phantom line position shown in FIG. 12. This movement pulls the wheelslide assembly 58 to the left via the rod 122, compressing the spring 136 within the tube 138. Rod 122 is thus the primary mechanical connection between lever 114 and wheelslide 58, while spring 136 exerts the bias force tending to urge the wheelslide away from the workhead to the extent permitted by the cam 42.

In summary, the wheelslide housing 58 is mounted for longitudinal displacement over the slidebars 54 and 56 by means of bearings 60, 61 and 66. The longitudinal displacement control cam 42 rotates with the cam shaft 40 to pivot the wheelslide displacement control lever 114 angularly away from the base 12. As the free end of lever 114 moves away from the base 12 rod 122 pulls the wheelslide housing 58 in the direction of the workhead 20 compressing the spring against the inner end of the tube 132 which is mounted on the base by means of bracket 134. As the cam 42 rotates to a contour of lesser radius, the bias force exerted by the compressed spring 136 moves the wheelslide housing 58 back away from the workhead 20 to the degree permitted by the positive contact between the cam lever roller and the cam.

Figure 14:
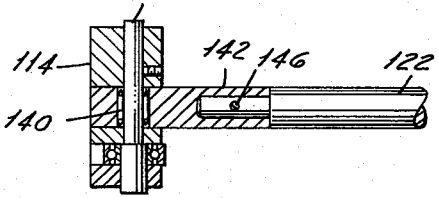
FIG. 14 is a detail of the spring rod assembly.

FIG. 14 shows the detail of the interconnection between the rod 122 and the upper or free end of the cam control lever 114. It will be noted that needle bearings 140 are provided between the bore through the end section 142 of rod 122 and the pivot pin 144 so that the rod 122 is free to rotate relative to the free end of the lever as the lever moves in and out relative to the base. A shear pin 146 interconnects the main portion of the rod 122 with the end portion 124 to guard against excessive longitudinal load imposed by obstructions or other unforseen difficulties.

Looking to FIGS. 10, 11 and 12 it can be seen that the wheelslide control lever 114 is of extremely heavy duty and hence rigid construction having solid outer members interconnected by stiffening ribs so as to avoid any flexing in operation. The roller 112 is mounted approximately two-thirds of the way up from the pivoted end 116 of the lever 114 and is mounted in suitably lubricable bearings as shown in FIG. 11. At the upper end of the lever 114 a threaded stop shaft 160 extends through the lever and abuts a mechanical stop 162 which is mounted on the base 12 as best shown in FIG. 12. This mechanical stop arrangement is provided to provide a mechanical limit of travel for the lever 114 toward the base 12 whenever an insertion gap in the cam 42 passes by the face of the cam roller 112.

Lateral Feed Mechanism

Looking now to FIGS. 9 and 15 through 20, the details of the feed mechanism for producing controlled uniform increments of lateral displacement between the wheel spindle 18 and the workhead will be described.

Figure 15:
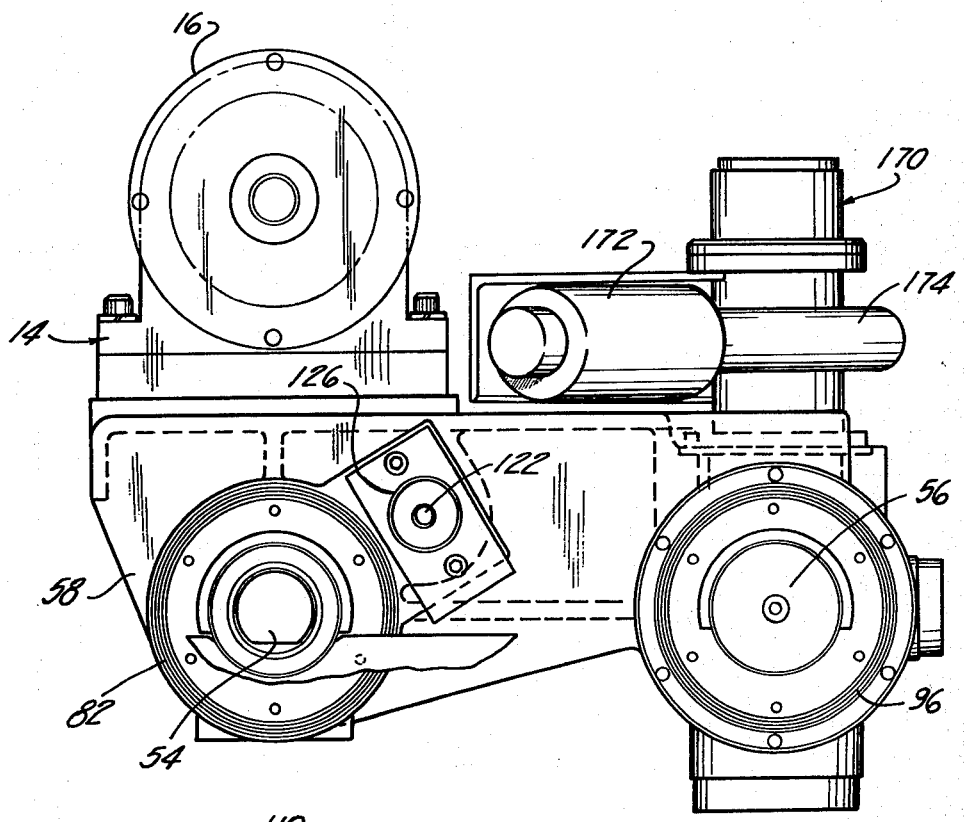
FIG. 15 is an end view of the wheelslide assembly and slidebar showing the location and orientation of the lateral feed motor.
Figure 16:
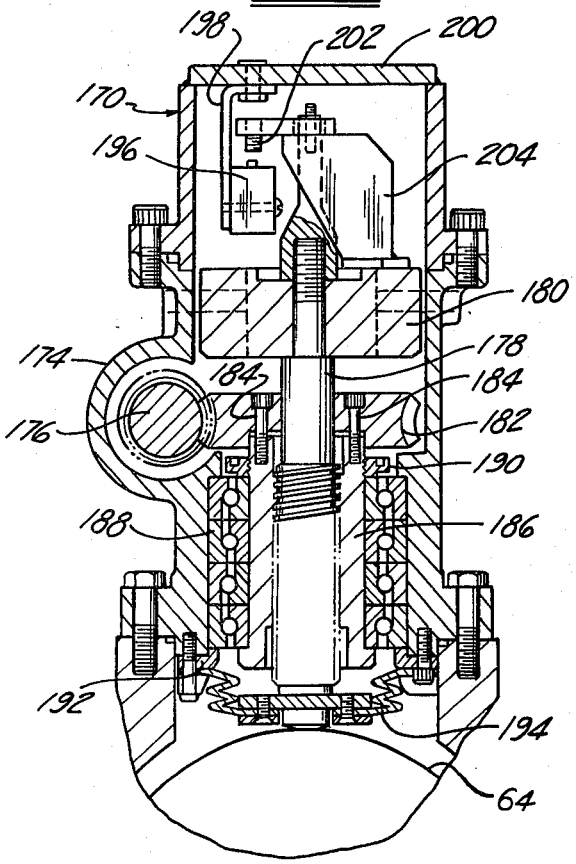
FIG. 16 is an end view in section of the mechanical interconnection between the lateral feed motor and the rear slidebar bearing.

In FIG. 15 the end of the wheelslide 58 is shown in the assembled state on front slidebar 54 and rear slidebar 56 with the wheelhead 16 mounted directly above the front slidebar 54 on the base 14 so as to slide along an axis normal to the plane of the paper in the drawing of FIG. 15 as previously described. The wheelslide fine position adjustment knob 126 of the end of the wheelslide rod 122 is also shown in FIG. 15. Wheelslide 58 is shown to carry toward the right side thereof as viewed in FIG. 15 a feedcase assembly 170 within which the mechanism for pivoting the wheelslide 58 about the center line of the front slidebar 54 is substantially contained. The details of this unit are shown in FIG. 16 and will be described promptly hereinafter. By way of general description the feedcase 170 is mounted substantially vertically on the wheelslide and is mechanically connected to the lateral feed motor 172, a digital stepper motor for rotating a worm shaft 176 which is disposed within a housing 174 thereby to pivot the entire wheelslide about the axis of the front bar and accomplish lateral feed of the wheelhead 16.

Looking to FIGS. 16 through 20 the feedcase 170 is shown to comprise a vertically oriented shaft 178 which is held by key 180 so as to be incapable of rotation within the feedcase 170. The lower end of shaft 178 rests upon a portion of the sleeve 64 which is disposed on bearings 66 about the rear slidebar 56. Worm shaft 176 is in meshing engagement with a worm gear 182 which is mechanically connected by machine screws 184 to a nut 186 which in turn is threaded onto the shaft 178. The nut 186 is rendered rotatably relative to the feed case 170 by means of "QUADRUPLEX" bearings 188 which are axially stacked within the feed case 170. It can be seen that the bearings 188 are trapped between a shoulder on the lower end of the nut, an upper retainer ring 190 and a lower retainer ring 192. An accordian pleated dust guard 194 is secured to the lower retainer ring 192 and to the shaft to keep foreign particles out of the bearings 188.

It can be seen that excitation of the feed motor 172 rotates the worm shaft 176 which in turn rotates the worm gear 182. The worm gear 182 rotates the nut 186 to force the nut to travel along the shaft 178. Since the lower end of the shaft bears directly on the sleeve 64, the axial travel of the nut along the shaft is accomplished by travel of the feed case 170, the axis of rotation again being the center line of the front slidebar 54. Since the wheelhead 16 is mounted at a radial distance from the center line of the front slidebar 54 is is apparent that travel of the nut 186 along the shaft 178 and the consequent rotation of the feedcase 170 about the center line of the slidebar 54 causes an arcuate but primarilly lateral movement of the spindle 18. However, because this travel is limited to a very short distance, the lateral feed is for all practical purposes linear rather than arcuate.

An absolute zero detection for digital feed position reference is provided by a switch 196 which is mounted on a bracket 198 fixed to the upper cap 200 of the feed case 170. The switch is operated by an adjustable screw 202 which is mounted on a bracket 204 which is secured to the key 180 on the upper end of the shaft 178. Therefore, as feedcase 170 moves up and down the switch 196 moves with it and, when the plunger end of the switch 196 engages the screw 202 an absolute lateral feed position signal may be generated.

Figure 18:
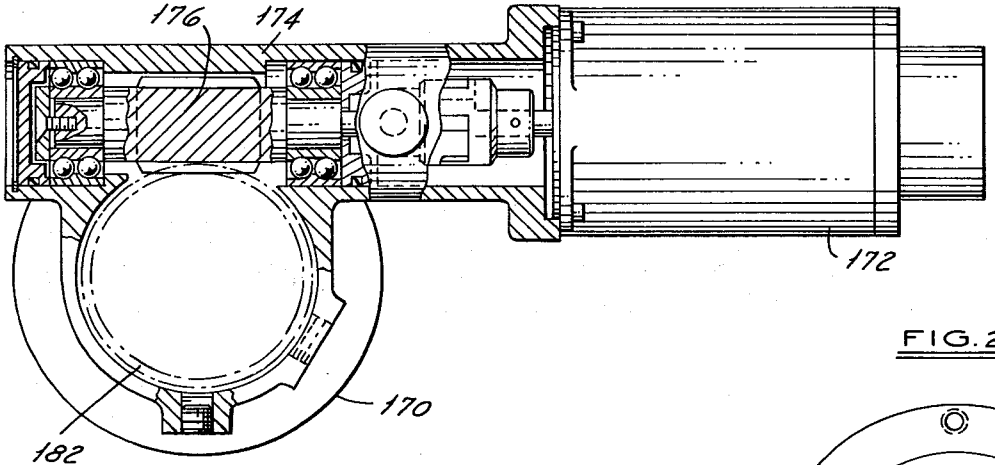
FIG. 18 is a plan view in section of the lateral feed motor and drive.
Figure 20:
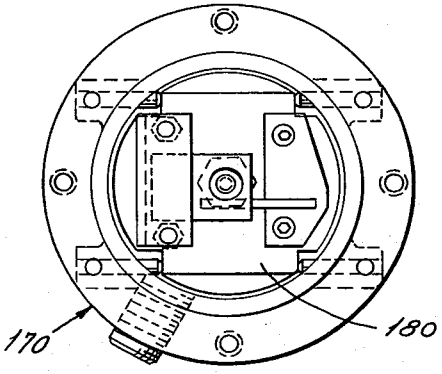
FIG. 20 is a detail of the lateral feed assembly.
Figure 19:
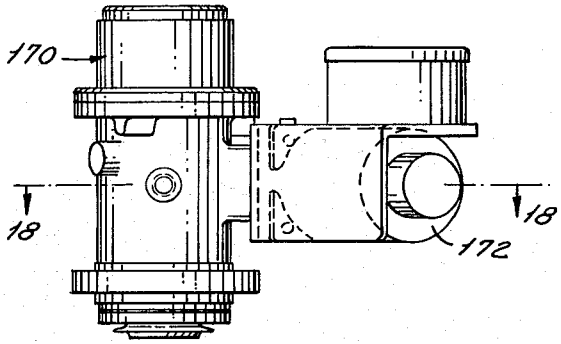
FIG. 19 is a front view of the lateral feed case.

FIG. 18 shows the details of the bearings for the shaft 176 within the feedcase gear housing 174 and the meshing engagement thereof with the worm gear 182 on the feed nut 186.

Figure 9:
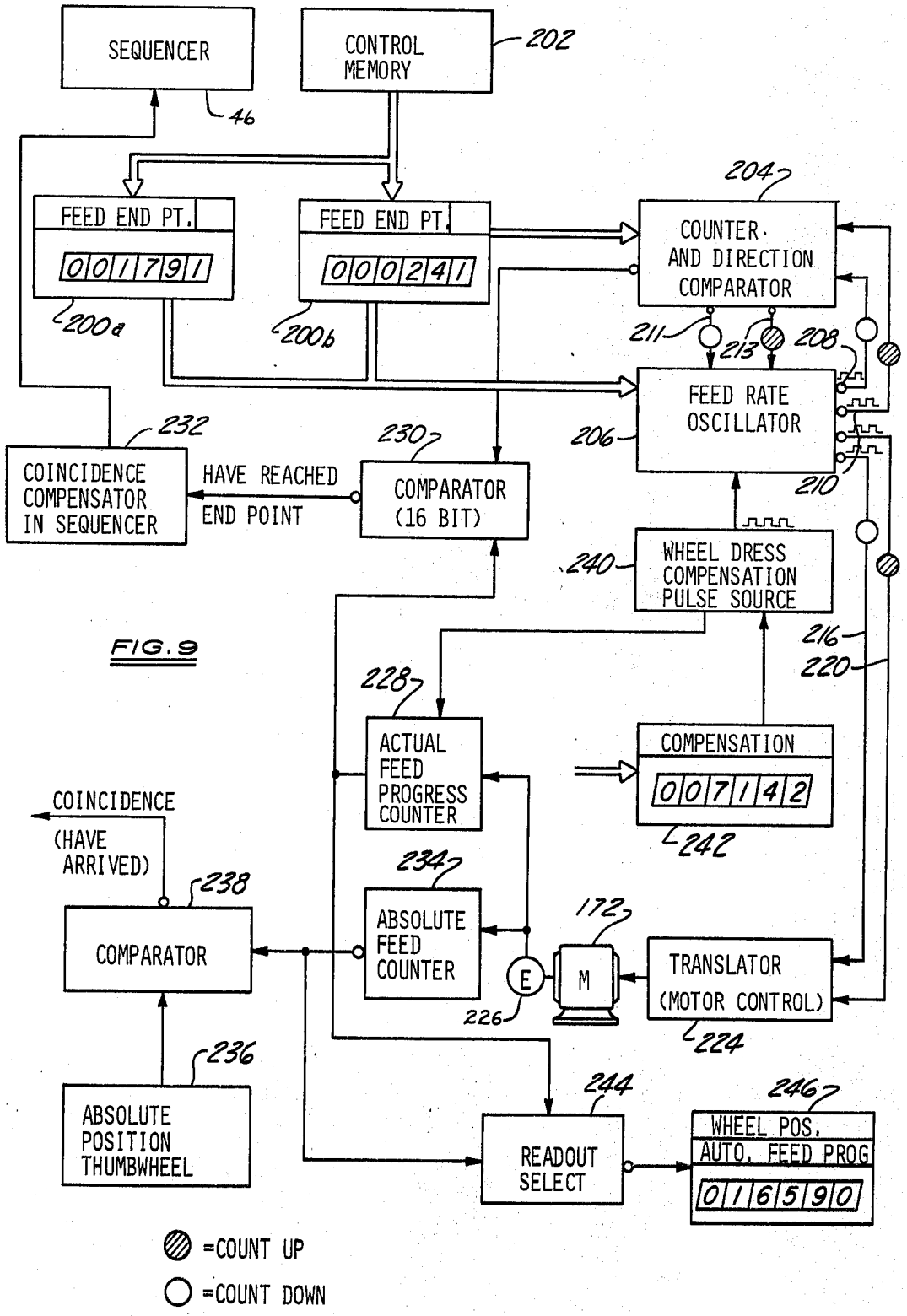
FIG. 9 is a block diagram of the lateral feed motor control circuit.

Looking not to FIG. 9 the digital control circuit for the feed motor 172 is shown. The control circuit comprises a plurality of digital thumbwheel switch sets 200*a*, 200*b*, etc. for setting feed end points, measured relative to some reference position, and feed rate data. Each switch set 200 comprises several digits for fine position designation. Switch sets 200 may be disposed in the display panel 148. A memory portion 202 of sequencer 46 selectively and individually feeds the digital end points represented by sixty bits of position data into a counter-comparator 204. In addition, eight bits of feed rate information are fed to a rate oscillator 206 which produces position increment pulses. Comparator 204 compares the count received from the selected end point switch set 200 to the current count of position increment pulses from oscillator 206 and selects one of the outputs 208 and 210 to feed count-down or count-up pulses to the comparator 204. The particular output actuated is such as to try to equalize the input position count (command) with the current position count; i.e., the current position count is either decreased or increased as necessary. Outputs 216 and 220 are alternatively selected to direct position increment pulses to the translator 224 which in turn control motor 172; i.e., the lateral feed motor. The number and direction; i.e., count-up or count-down, of pulses directed to translator 224 is typically the same as the number and direction of pulses directed to comparator 204. Thus, the feed motor turns through a rotational increment related to the number of pulses received. This increment of position change, either positive or negative, is reflected in the current position count in comparator and continues to change until the commanded and current position counts are the same. Summarizing, control memory 202 operates so as to select or excite the thumb wheel switch sets in some sequence related to the grinding program. When a thumb wheel switch set is selected, a digital position signal comprising some 60 position bits and 8 rate bits is fed to the counter and direction comparator 204 and to the feed rate oscillator 206. The left-hand input to the comparator 204 is the new position command and the right-hand input to the comparator is the old or current position signal. By comparing the two counts, the comparator 204 can determine the direction in which it needs to proceed to equalize the new position command with the current position signal. Assuming the switch position is greater than the current counter number, output 213 is actuated to the feed rate oscillator causing it to produce count-up pulses which are applied to the right-hand input of the comparator 204. Obviously, these pulses increase the number stored in the right-hand side of the comparator. This will continue until the right-hand number equals the left-hand number in which case the comparator indicates that the commanded position has been reached and the flow of pulses from the rate oscillator will stop. The translator 224 is a commercially available motor controller and may be purchased as Model No. BTR-103 from Superior Electric Co. of Bristol, Connecticut.

The rotation of the output shaft of motor 172 turns an encoder 226 which applies pulses to the actual feed progress counter 228. This is part of the feedback connection and the pulses stored in the counter 228 are compared in comparator 230 to the left-hand number in the counter 204 and when the two are the same the signal is applied to the coincidence comparator 232 which forms part of the solid state sequencer circuitry. Counter 228 can be counted up as well as down.

The encoder pulses are also applied to the absolute feed counter 234 which maintains a count measured from an absolute zero position wherein the centerline of the wheel spindle 18 is in exact alignment with the centerline of the workhead. Note that this absolute zero position may be mechanically established in the machine. The output from the absolute feed counter is compared to the absolute position thumb wheel signal from switch set 236 in a comparator 238 and absolute position coincidence is indicated on the output line marked "coincidence".

The end points which are selected by the thumb wheel switches 200*a*, 200*b*, etc. are floating end points; that is, they are not referenced to the absolute zero position but rather are referenced to the new radius of the wheel after each wheel dress operation. In other words, the end points are in effect incremented each time the grinder wheel is dressed down thereby to compensate for the loss of grinder wheel radius that results from the dressing operation. This is not the case with the absolute position signal from thumb wheel 236. Wheel dress compensation is accomplished by means of the compensation pulse source 240 which, upon command from the controller, applies a small number of pulses to the feed rate oscillator, the exact number of pulses being established by a thumb wheel switch 242. These pulses actually count back the counter comparator 204 on the right-hand side so that now the comparator indicates that it has not yet reached the previously designated end point. The pulses from compensation pulse source do not, however, reach the translator 224 and therefore the motor does not "back-up" during the count back of the comparator 204. Once the comparator indicates it is no longer in position, it automatically generates such additional signals as are necessary to reenable gates 211 and 213 and send the same number of pulses from the oscillator to the translator as were just sent from the compensation pulse source to the comparator 204. Thus, the comparator gets back in position and pulses are applied to the translator to move the wheel spindle over by a position represented by the number of compensation pulses. Note that the compensation pulses also count back the actual feed progress counter 228 so it remains in agreement with the comparator 204.

The circuit also comprises a selector switch 244 which selectively directs either the absolute feed count or the actual feed count to the digital display 246 which is part of panel 48.

For additional details on the lateral feed circuit, reference should be taken to the copending application for patent, Ser. No. 465,333 filed concurrently herewith in the name of Roger L. Schroeder.

Reciprocation of Wheelslide—Grind Operation

Figure 21:
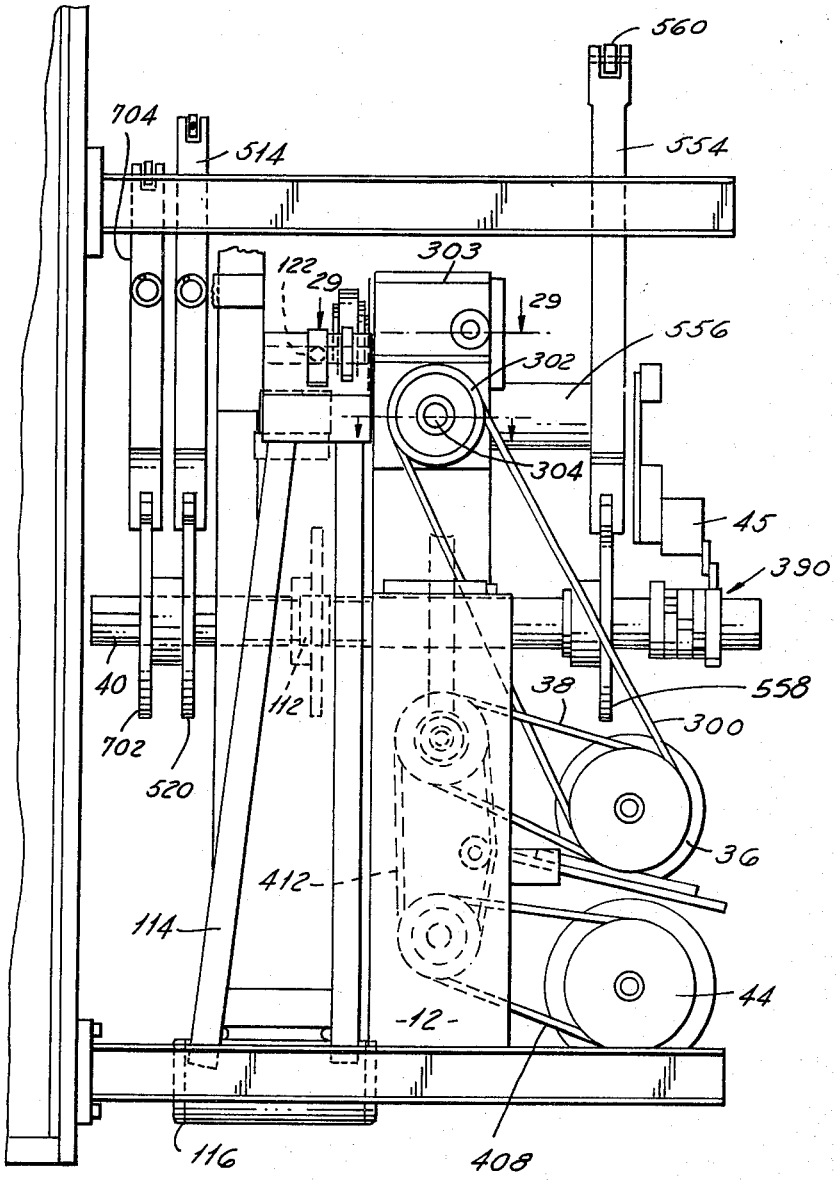
FIG. 21 is an end view of the drive machinery in the base indicating the interconnections between the motors, the programming cam shaft and the cam followers.
Figure 26:
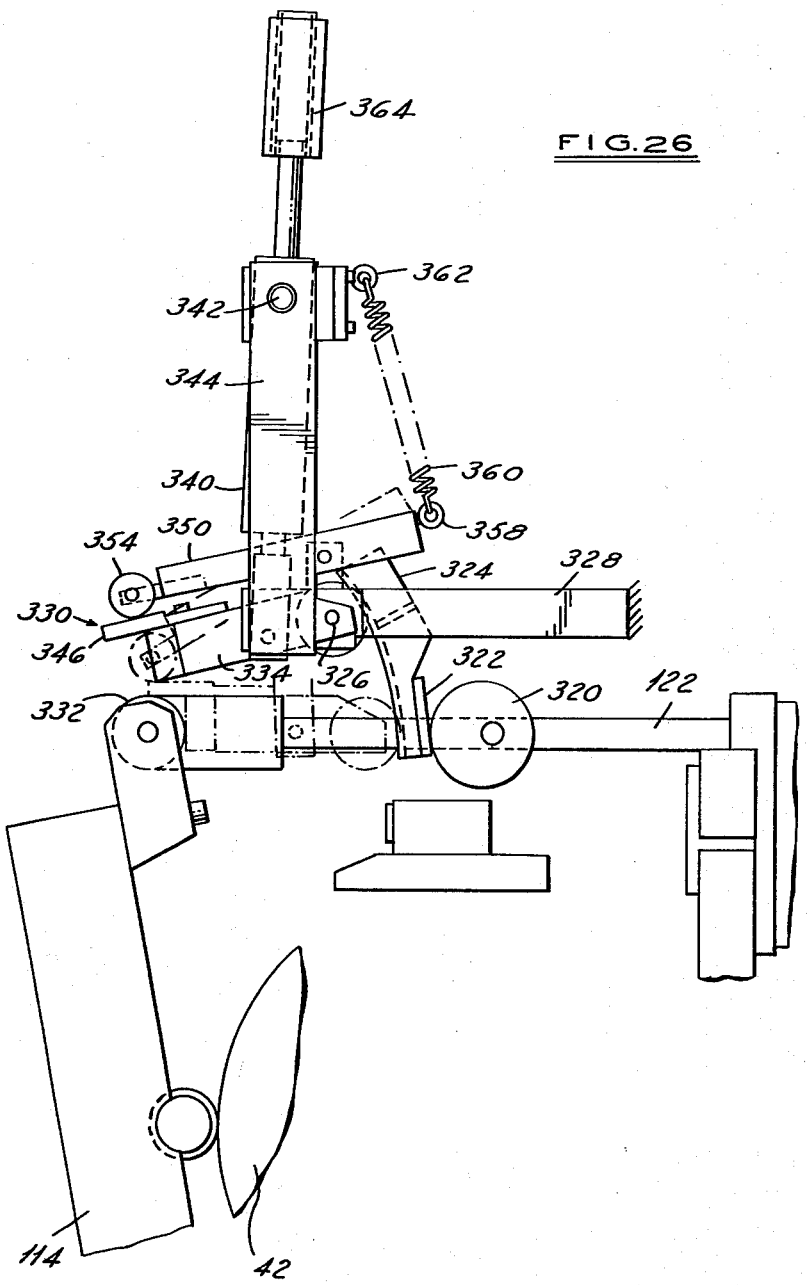
FIG. 26 is a side view of the reciprocator oscillator device used to produce reciprocating oscillatory displacement of the wheelslide.
Figure 27:
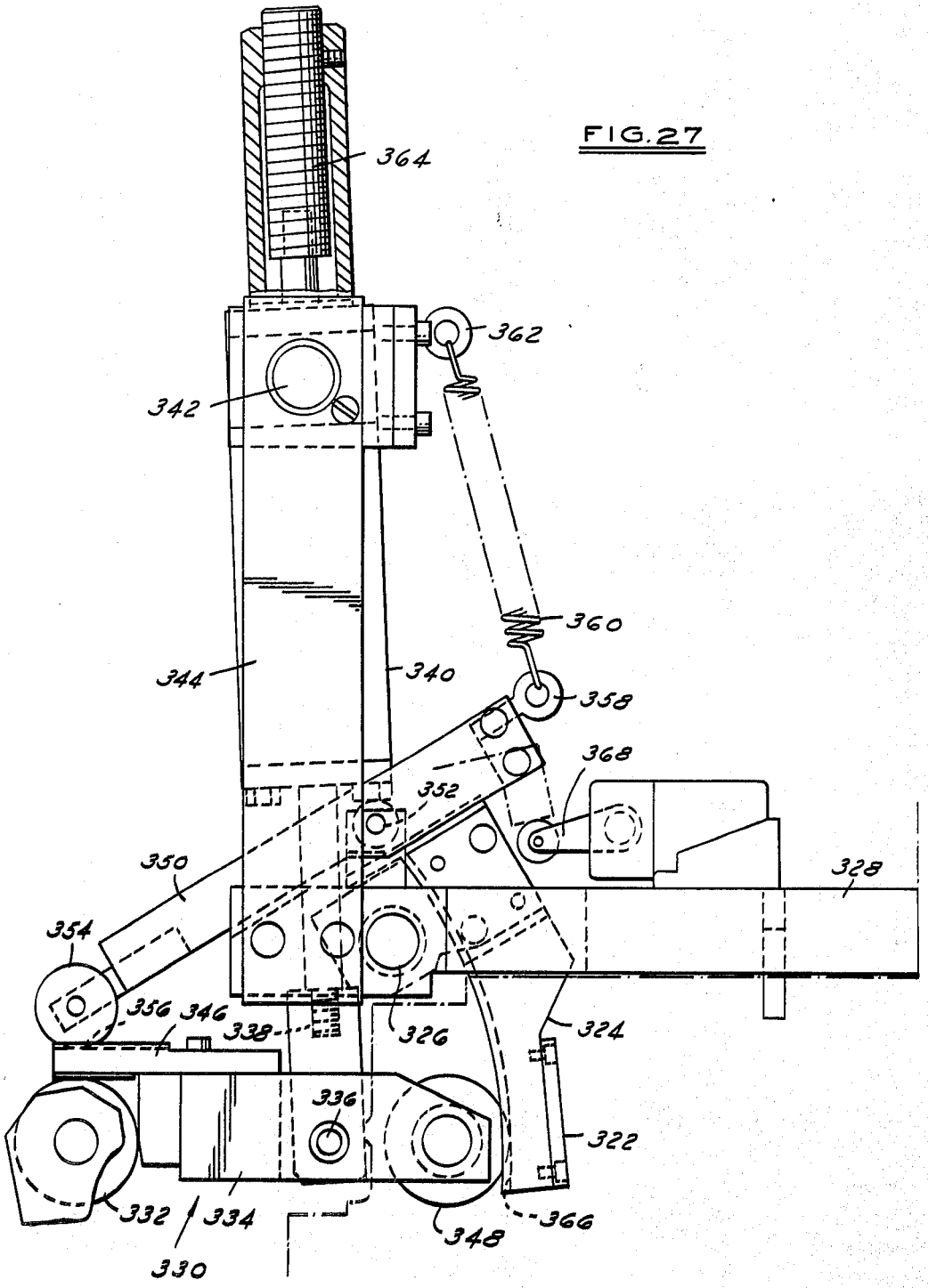
FIG. 27 is an enlarged side view of the reciprocator oscillator assembly.
Figure 28:
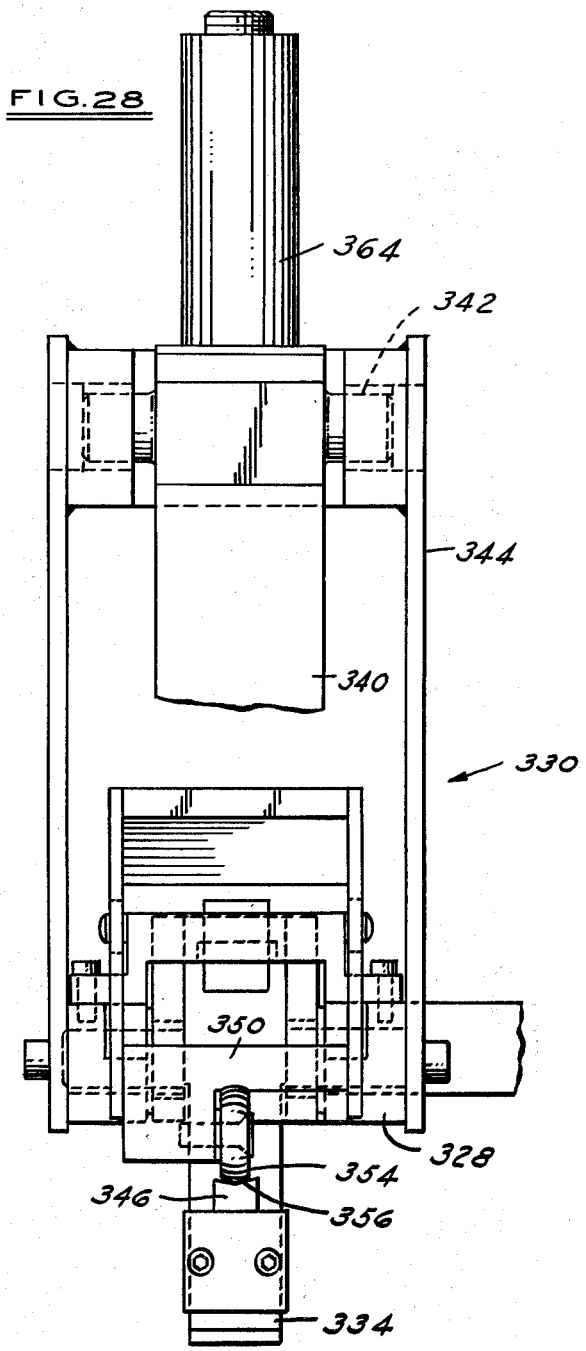
FIG. 28 is a plan view of the reciprocator oscillator assembly.
Figure 29:
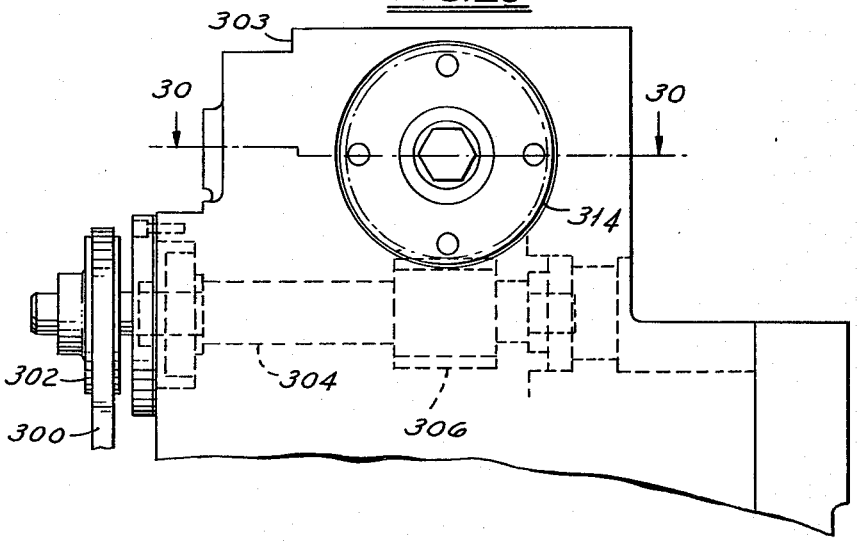
FIG. 29 is a front view of the reciprocator oscillator drive mechanism.
Figure 30:
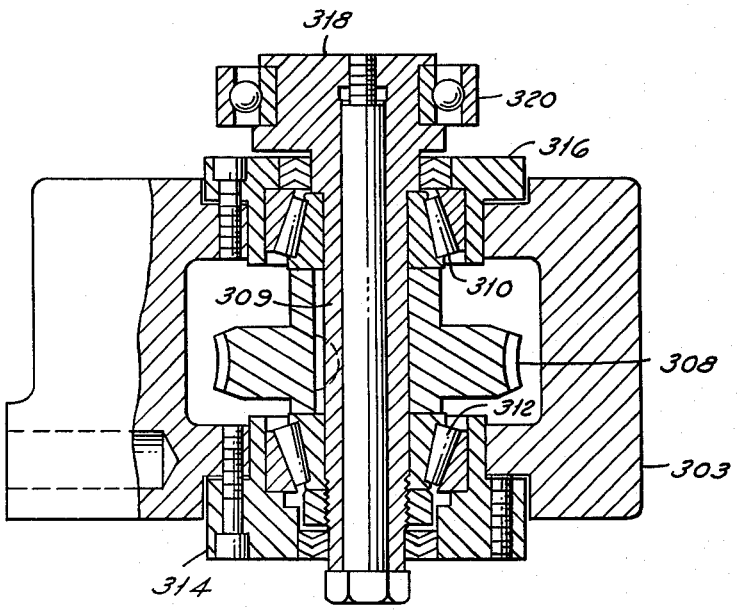
FIG. 30 is a cross-sectional view of the reciprocator oscillator drive mechanism.
Figure 31:
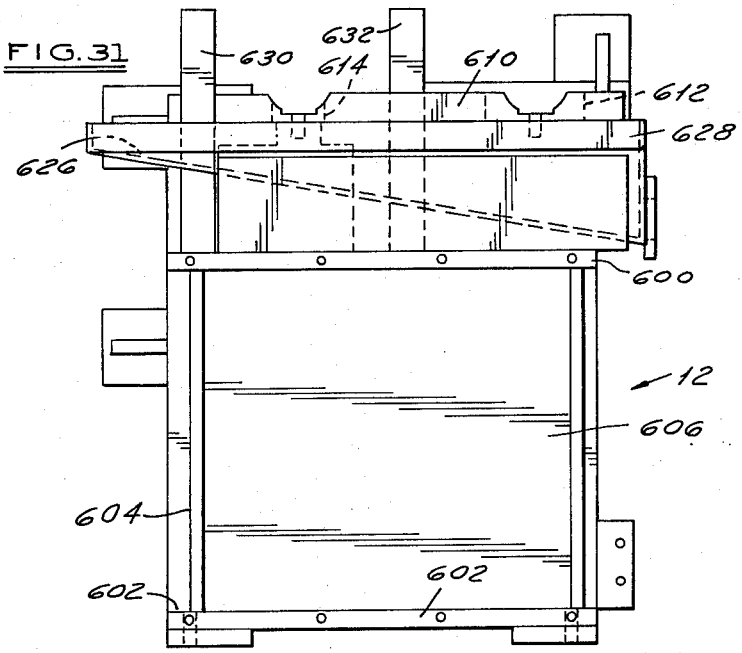
FIG. 31 is an end view of the machine base.
Figure 32:
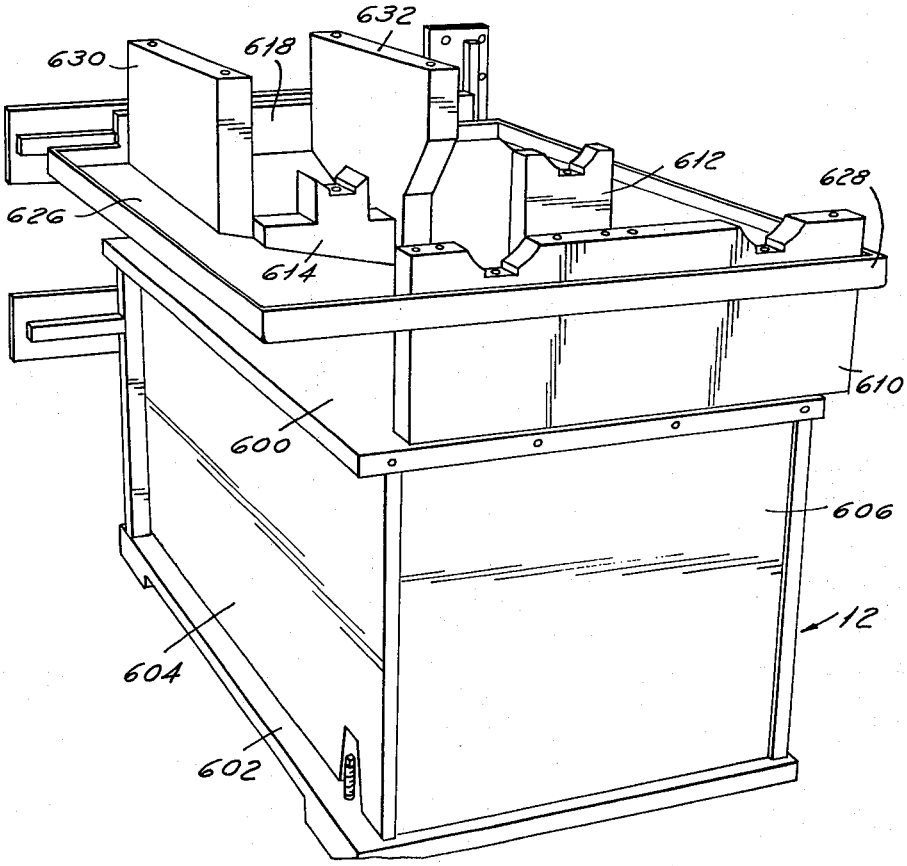
FIG. 32 is a perspective view of the machine base.
Figure 33:
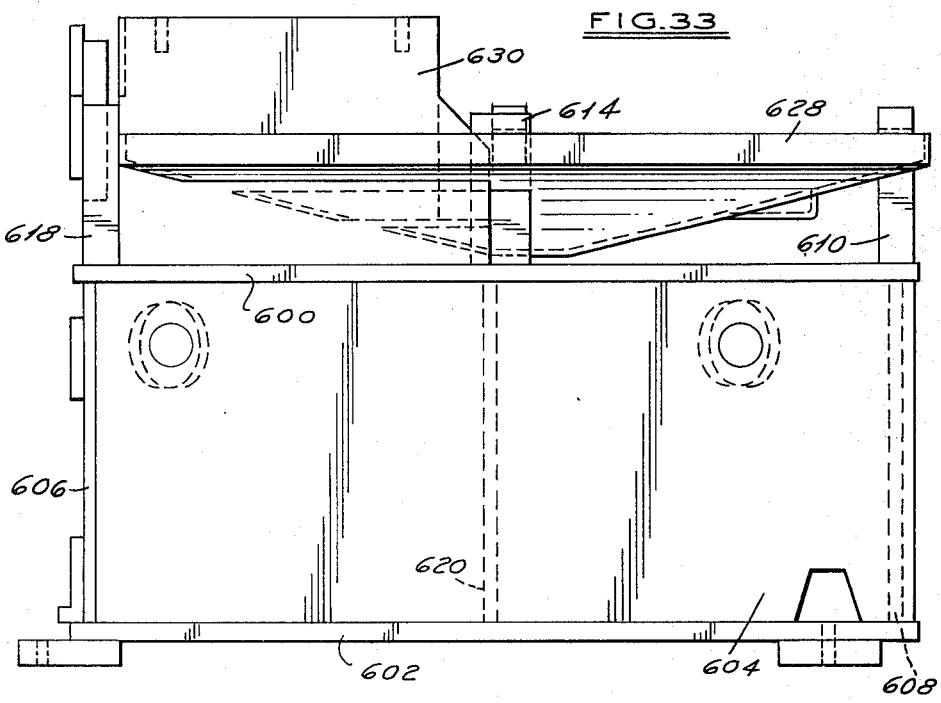
FIG. 33 is a front view of the machine base.
Figure 34:
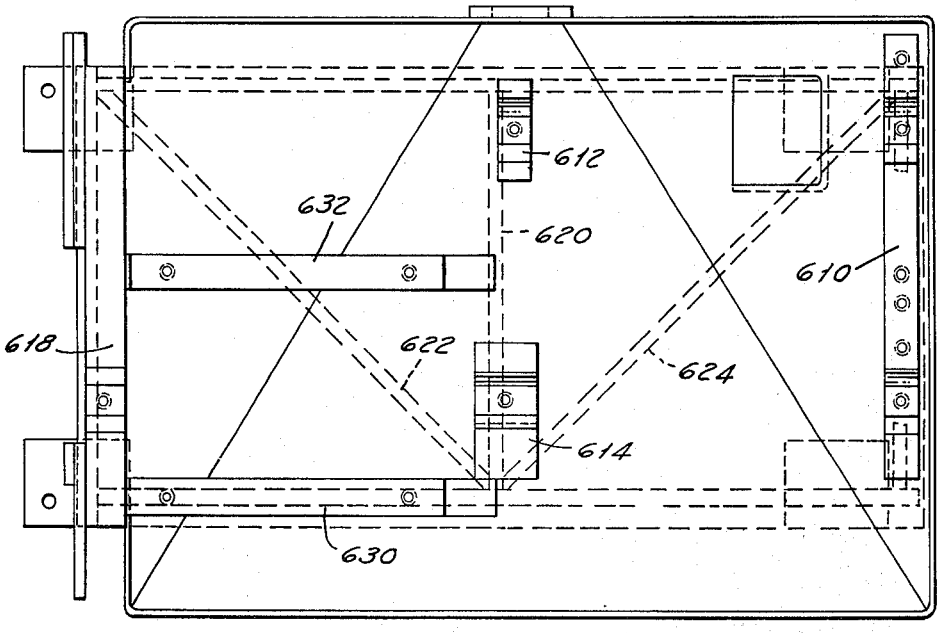
FIG. 34 is a plan view of the machine base.

Referring now to FIGS. 21 and 26 through 30, the mechanical details of the apparatus for producing selected and variable degree oscillation or reciprocating movement of the wheelslide during a grind operation will be described. FIG. 21 illustrates the main drive motor 36 connected by belt 38 to the gear drive mechanism for rotating the programming cam shaft 40 which governs the mechanically programmed machine functions including wheelslide displacement, part loading and unloading operations, and wheel dress operations. Motor 36 further drives belt 300 which engages upper pulley 302 mounted on gear case 303 which in turn is mounted on the machine base 12. As best shown in FIGS. 29 and 30 the pulley 302 is mounted for rotation with a worm shaft 304 having centrally located helically grooved portion 306 engaging worm gear 308 which crosses worm shaft 304 at right angles. Worm gear 308 is mounted on a driven shaft 309 which in turn is disposed in axially spaced tapered roller bearings set 310 and 312 for rotation relative to the gear case 303. An outer race 314 is mounted to the gear case 303 by machine screws at one end of the shaft 309 as shown in FIG. 30 and a second outer race 316 is mounted in the gear case at the opposite end of the shaft. Shaft 309 is shown to comprise the eccentric portion 318 at the upper end thereof in FIG. 30. The eccentric portion 318 is provided with an outer ballbearing race 320 for engagement with a pad 322 on the free end of an oscillator lever 324 which is pivotally secured to the machine base at a pin location 326 (FIGS. 26 and 27). The pin 326 is secured to a main support plate 328 which in turn is secured to the machine base as suggested in FIG. 26. Accordingly, rotation of the shaft 309 by the motor 36 causes continuous rocking of the oscillator lever 324 by way of the continuously rotating eccentric 320.

Reciprocating motion of the wheelslide is accomplished by selectively inserting a spacer assembly 330 into the space between the oscillator lever 324 and the upper or free end of the wheelslide lever 114. When the spacer 330 is so inserted, the eccentric drives the lever 114 in a reciprocating motion thereby to reciprocate the wheelslide 58. As is best shown in FIGS. 26 and 27, the spacer mechanism 330 is insertable to varying degrees to selectively vary the amount or extent of reciprocating travel over a fairly broad range. This is accomplished by providing apparatus which, when operated, initially inserts the left end of the spacer mechanism 330 into the gap between the lever 324 and the roller 332 on lever 114 and variably displaces the right-hand end of the spacer mechanism 330 as viewed in FIGS. 26 and 27 along the track on the inside or concave surface of lever 324; the greater the extent of insertion, the greater the degree of oscillatory displacement which is transferred to the wheelslide from the eccentric 320. Since the eccentric drives the lever 324 and the lever 324 drives the wheelslide lever 114 through the spacer, the wheelslide lever 114 causes displacement of the wheelslide 58 relative to the machine base 12 through the rod 122 as previously described. Reciprocating wheelslide displacement is independent of the mechanical rotation of cam shaft 40 and the associated wheelslide control cam 42 except, of course, that the cam shaft 40 must be in the angular position which corresponds to "grind" position of the wheelslide. This is indicated by one of the limit switches 45 mounted adjacent the cam shaft stop assembly 390 as best shown in FIGS. 21 and 25. Assembly 390 comprises a grooved collar 391 which carries manually adjustable stops 392 to trip the associated cam shaft limit switch 45 at selected angular positions of the cam shaft. These limit signals may be conducted to sequencer 46 to indicate the condition of the machine elements in the course of controlling a given programmed sequence.

Describing now the mechanism for selectively and variably inserting the spacer 330, the spacer 330 comprises a body 334 which is mounted on pivot 336 secured to the end of a threaded shaft 338 which extends from an air cylinder 340. The air cylinder is mounted on pivot 342 which in turn is secured by bracket 344 which is mounted on the machine base. Body 334 carries an extension member 346 on the upper left end thereof as seen in FIGS. 26 and 27 to seat on the roller 332 when the spacer is inserted. A roller 348 is pivotally secured to the right-hand end of the body 334 to ride in the V-shaped groove in the face of the oscillator lever 324 as previously described. To insure that the left end of the spacer 330 is always inserted first, a lever arm 350 is pivotally mounted on the machine bed for pivotal displacement about pin 352 and carries on the left end thereof a roller 354 which rides in a shallow track 356 in the upper surface of the extension member 346. The right-hand end of the lever arm 350 has mounted therein a screw eye member 358 which serves as an anchor for one end of a tension spring 360. The other end of the tension spring 360 is secured in an eye 362 which is mounted on the bracket 344 which carries the air cylinder 340. The tension spring 360 exerts a continuous force on the pivot arm 350 tending to rotate it in a counterclockwise direction as viewed in FIGS. 26 and 27. Accordingly, when the air cylinder 340 is actuated to extend the output shaft 338, the right-hand end of the spacer is held up until the left end or extension member 346 engages the roller 332 after which time the body 334 is inserted into the oscillator control gap, the degree of insertion being regulated by the stroke of the air cylinder. As the stroke becomes longer the roller 348 is driven more fully toward the bottom or free end of the lever 324 which is in continuous rocking motion due to the engagement thereof with the eccentric 320.

In operation, the knob 364 which controls the stroke length of the air cylinder 340 is adjusted to select the length of reciprocating wheelslide displacement travel which is desired. The wheelslide reciprocation movement may be then selected by the sequencer 46 at a given point in a grind operation and the cylinder 340 is actuated to drive the spacer 330 downwardly into the gap between the rocking lever 324 and the wheelslide lever roller 332. The extension of the air cylinder output shaft initially drives only the left-hand end of the body 334 downwardly in an arcuate path around the pivot 326 until the extension member 346 seats on the top of the roller 332 and the front face of the body 334 also abuts the roller 332. At this point further extension of the output shaft 338 causes the body 334 to pivot about the center line of roller 332, the roller 348 moving downwardly along the track 366 in the face of the lever 324 until the air cylinder output shaft is fully extended. If the roller 348 fails to move beyond the line between the center of roller 332 and pivot pin 326, the degree of oscillatory motion which is transferred from the lever 324 to the wheelslide is zero. If the roller 348 moves to the lower most extremity; i.e., the far free end of lever 324 as shown in solid lines in FIG. 27, a maximum degree of oscillatory travel is imparted to the wheelslide by the lever 324. Intermediate locations of roller 348 along the arcuate track of lever 324 produce intermediate degrees of oscillation travel as will be immediately apparent to those skilled in the art. A limit switch 368 may be mounted on the support plate 328 for detection of engagement or non-engagement of the reciprocating grind mechanism.

New Wheel Dress Operation

Figure 43:
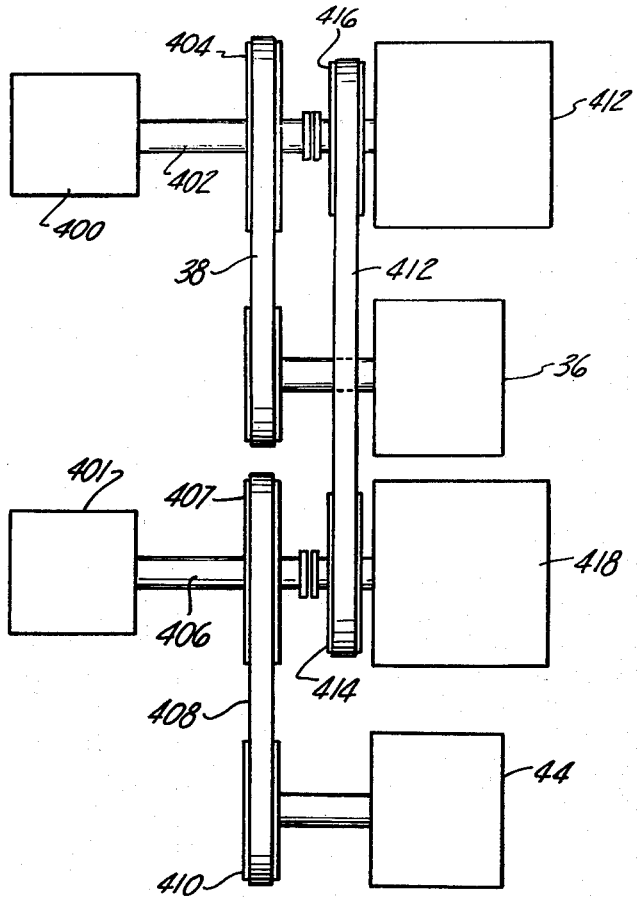
FIG. 43 is a schematic diagram of a motor and clutch arrangement for driving the mechanical programming cam.

Referring now to FIGS. 21 and 43, the apparatus for carrying out a new wheel dress operation will be described. As previously described with reference to FIG. 1 the grinding machine 10 employs two drive motors for mechanical programming system 34, the A.C. motor 36 which is a high-speed synchronous motor normally employed to rotate the cam shaft 40 and to perform such other functions as rotating the eccentric which is part of the reciprocating grind operation immediately described above; and a variable speed D.C. motor 44 for driving the cam shaft 40 during certain other operations. Both of the motors 36 and 44 are rotating at normal speed at all times when the grinder 10 is in operation. The motors 36 and 44 are selectively clutched into driving operation by means of electromagnetically operated clutches 400 and 401, clutch 400 being connected to control shaft 402 carrying pulley 404 which is connected to belt 38. As previously described with reference to FIGS. 1 and 21 belt 38 is continuously driven by the A.C. motor 36. Clutch 401 is mounted on shaft 406 which carries pulley 407 which is driven by the belt 408. Belt 408 is mounted on the pulley 410 which is connected to the output shaft of the D.C. motor 44. In addition, belt 412 is connected between pulleys 414 and 416 on shafts 406 and 402 respectively. When clutch 400 is engaged the A.C. motor 36 drives the worm shaft and worm gear drive mechanism 412 to rotate the cam shaft 40 of the mechanical programming system. With clutch 401 disengaged, the D.C. motor merely idles, there being no mechanical connection between the pulley 407 and the pulley 414. The belt 412 rotates with the shaft 402 driven by A.C. motor 36 through belt 38 to rotate the idler bearing assembly 418 which is mounted on the machine bed 12. With clutch 401 engaged and clutch 400 disengaged D.C. motor 44 drives the worm shaft and worm gear assembly 412 by way of belt 408 and belt 412, A.C. motor 36 being disengaged by virtue of the mechanical disconnection between pulleys 404 and 416. Suitable electromagnetically operated clutches are available from the Warner Electric Brake and Clutch Company of Beloit, Wisconsin.

Figure 40:
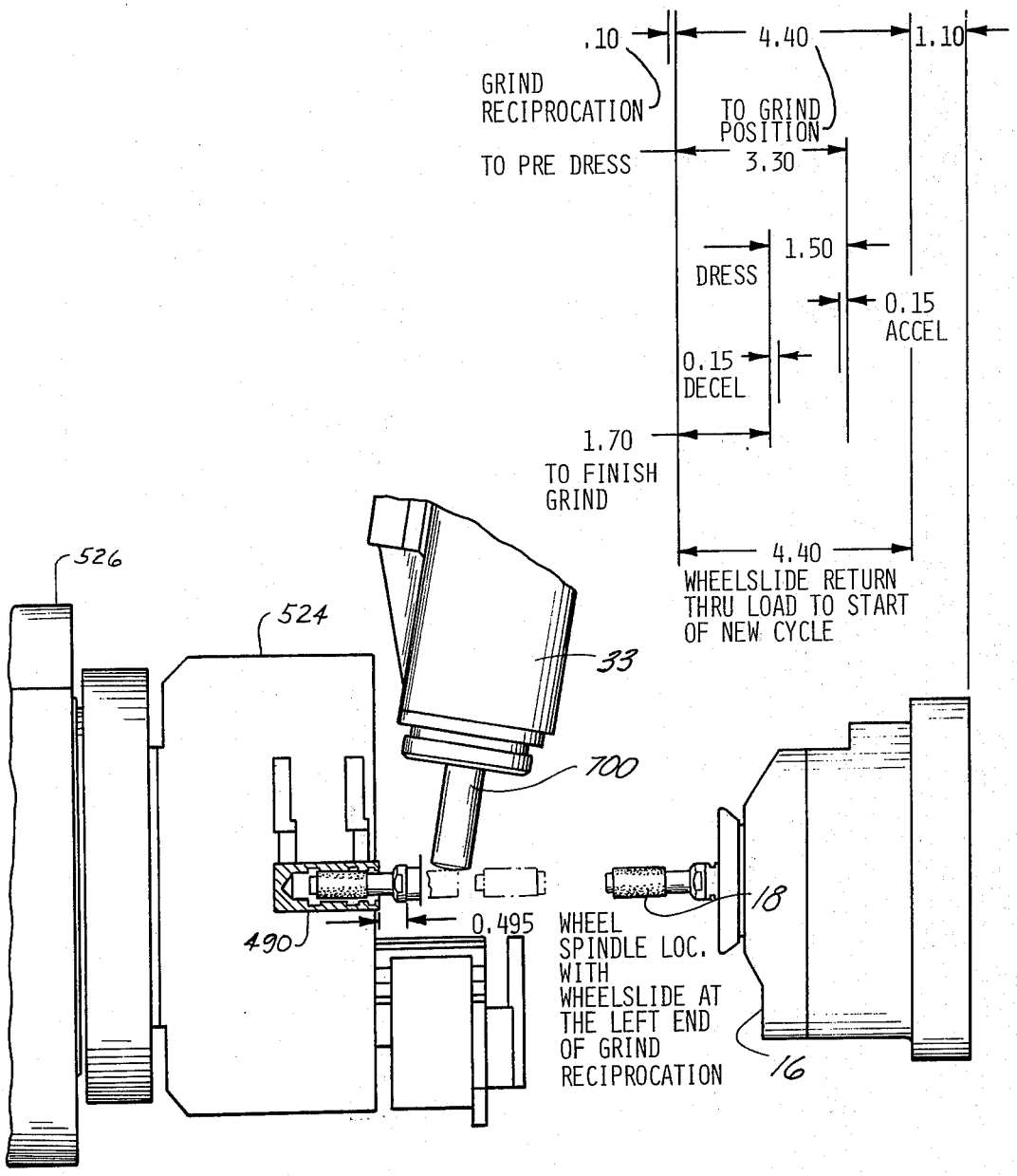
FIG. 40 is a schematisized drawing of the workhead and wheelhead and dresser with the graphical indication of the longitudinal displacement program.

To perform a new wheel dress operation the dresser 33 is lowered into the dress position as shown in FIG. 40 where it is in interfering relationship with the wheel 18 mounted on the spindle of the wheelhead 16. The wheelslide 58 is then fed to the appropriate lateral position displaced to advance the wheel 18 into engagement with the dresser to begin to reduce the wheel 18 to a uniform and a predetermined diameter. The new wheel dress operation requires that the wheel 18 be advanced so as to dress the entire length of the wheel, such axial displacement being typically greater than that which may be provided by the eccentric drive reciprocating motion previously described. Accordingly, to accomplish the new wheel dress the sequencer 46 programs a timed or counted sequence of cam shaft direction reversals by alternately actuating the motors 36 and 44, one of the motors having been reversed in the direction of rotation prior to the initiation of the new wheelgrind operation.

Part Loader Apparatus

Referring now to FIGS. 1, 21, 22, 35 through 37, 41 and 42, the details of an illustrative part loader apparatus and the programming apparatus for controlling the part loader will be described.

Figure 22:
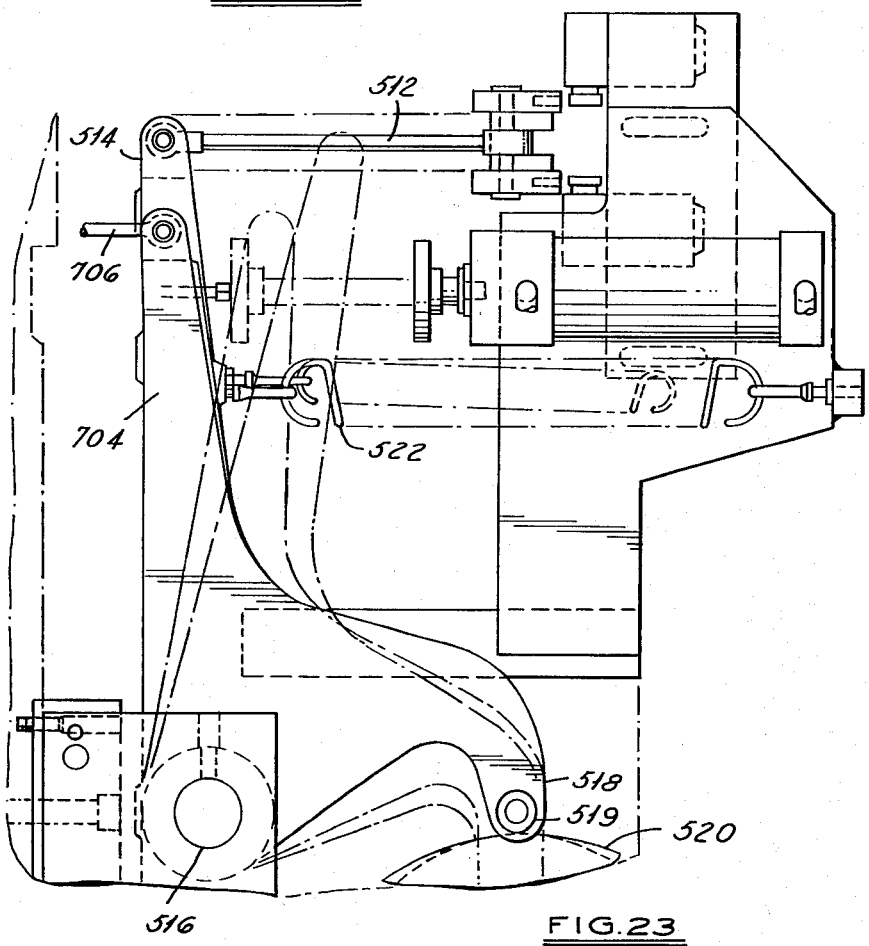
FIG. 22 is a rear view of representative part loader and dresser control levers.
Figure 23:
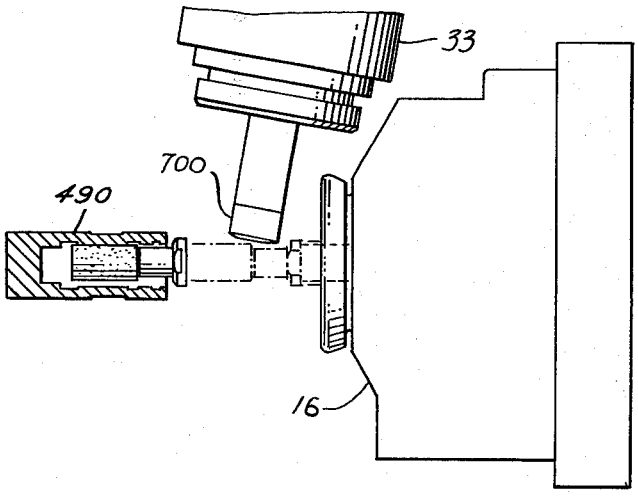
FIG. 23 is a schematisized drawing of a dresser indicating the orientation thereof relative to the wheelhead.
Figure 41:
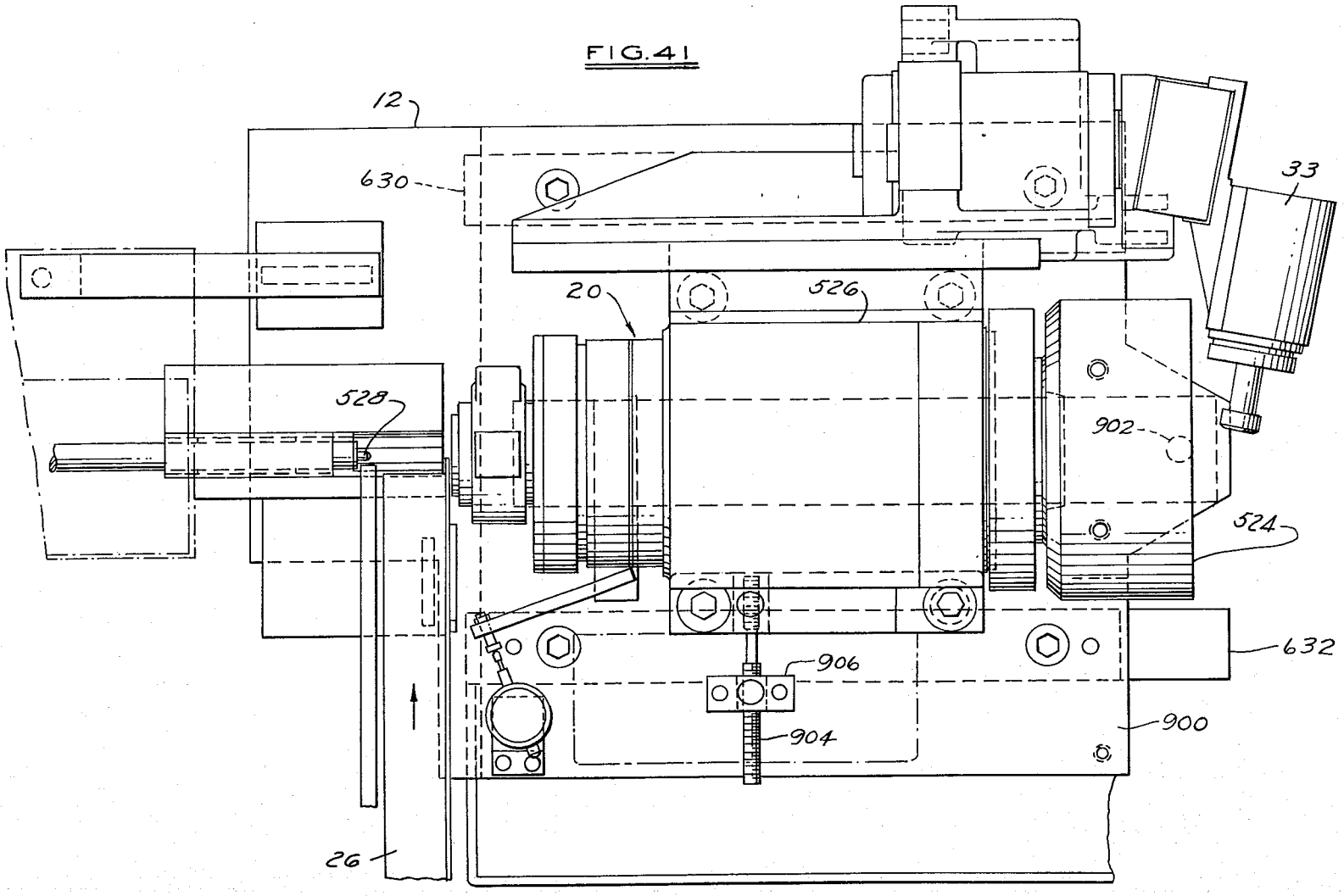
FIG. 41 is a plan view of the workhead and part loader apparatus and wheel dresser.

As shown in FIG. 1 parts such as cylindrical shaped valve lifter bodies 490 (FIG. 23) are loaded into a load chute 26 in parallel side-by-side relationship. Load chute 26 is inclined as best shown in FIG. 35 such that the parts tend to roll downwardly toward seat pads 500 on the part rest fixture 502. Switch 503 produces a cycle enabling signal when the load chute is not empty. A valve lifter body in seat pads 500 is coaxially aligned with the center of the part holder chuck 524 (FIG. 41). From this position parts 490 are pushed in a coaxial column through the interior passage 527 of the workhead 526 by plunger mechanism 528. This plunger mechanism is operated by a push rod 504 which is pivotally connected to a lever 506 which pivots about fulcrum 508 carried on the end of a support arm 510. The arm or lever 506 is connected at the opposite end to the turn buckle rod 512 which in turn is connected to the upper end of a mechanical programming cam lever 514 which is best shown in FIG. 22. The cam lever 514 is mounted on the pivot 516 for pivotal displacement relative to the grinder base 12 and comprises a laterally extending portion 518 carrying cam follower 519 which engages the peripheral surface of a cam 520 mounted on the shaft 40 for rotation therewith. As the cam shaft 40 and the cam 520 rotate, the lever 514 pivots about point 516 as shown by the phantom view in FIG. 22 to control the position of the rod 512 thereby to intermittently push on the plunger mechanism 528 so as to advance the part column through the workhead 526 by a distance of one part length. This is a repeating cycle of part progression through the workhead 526 and into the chuck 524 as each part 490 is completed and removed from the machine. Cam lever 514 is maintained in contact with the cam 520 by tension spring 522 which is connected between the cam and the machine bed as shown in FIG. 22.

It will be understood that various other types of part load apparatus may be employed including pivotal arms which load the parts directly into the chuck rather than through the workhead as is illustrated in this instance. Accordingly, the part loader disclosed herein is to be taken as merely illustrative of the many varieties of part loader apparatus which may be employed in combination with a mechanical programming apparatus.

Part Unloader Apparatus

Referring now to FIGS. 1, 21, 38 and 39, the apparatus for unloading the parts 490 from the chuck after the completion of the grinding operation will be described.

Figure 38:
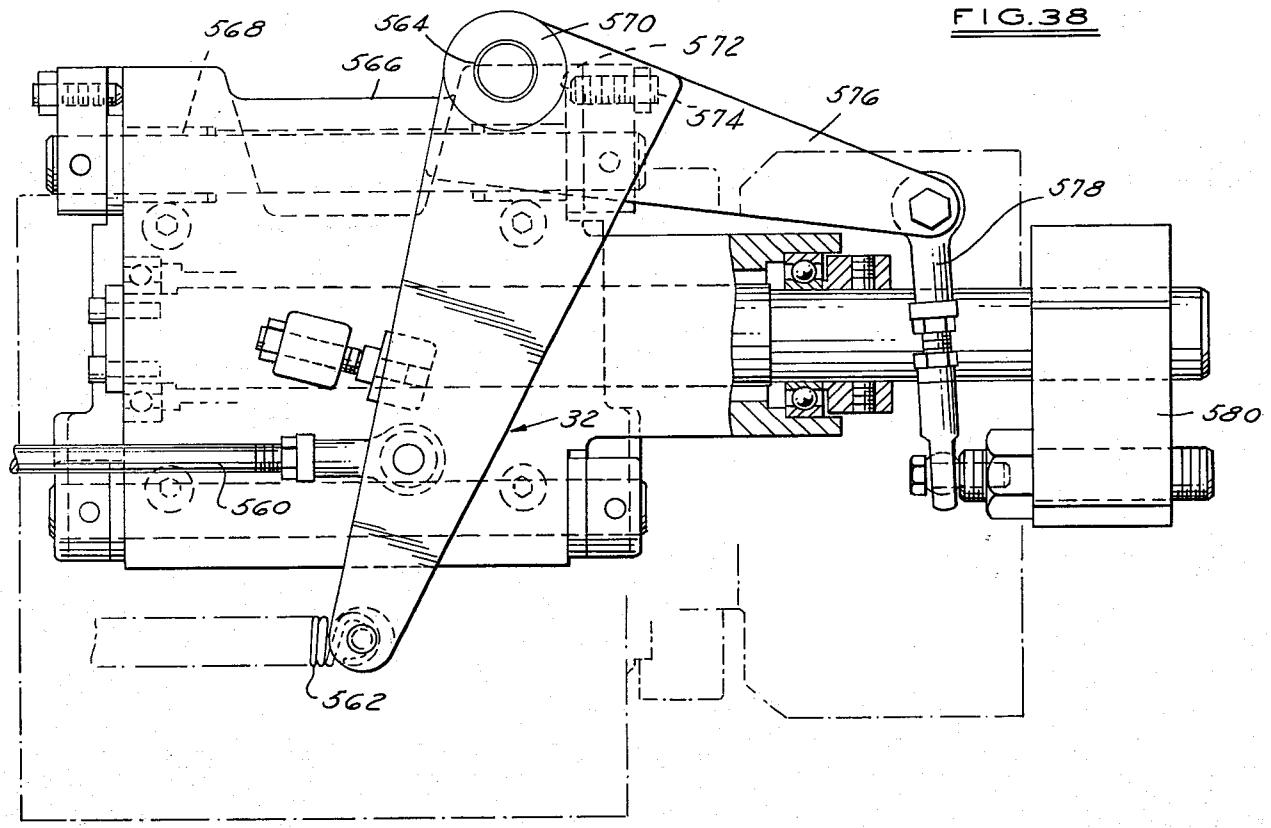
FIG. 38 is a front view of a part unloader assembly.
Figure 39:
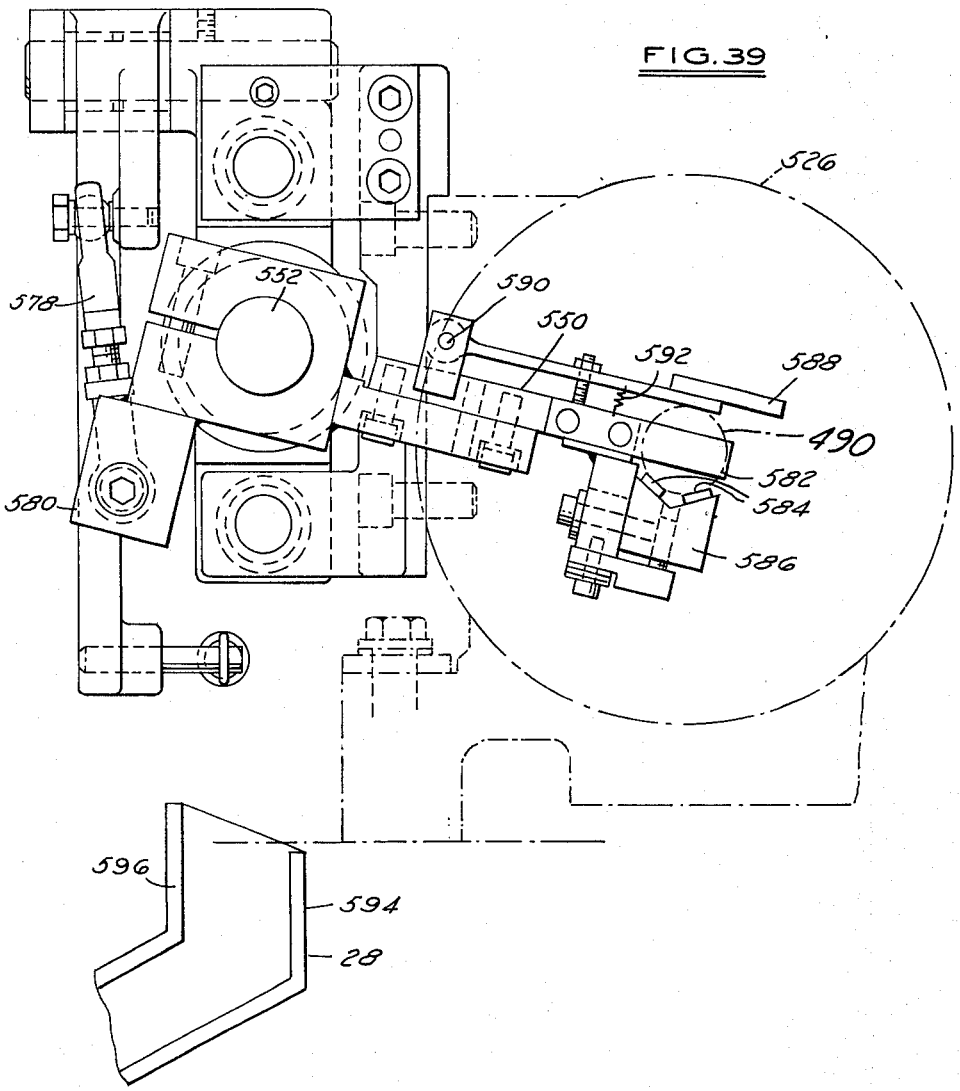
FIG. 39 is an end view of a part unloader assembly.

In FIG. 39 a gripper arm 550 mounted for pivotal movement about pin 552 so as to receive parts which are pushed out of the opened chuck 524 by the insertion of a new part from the rear and to swing clockwise, as seen in FIG. 39, to drop the parts into the discharge chute 28. The pivotal motion of the unloader arm 550 is controlled by a cam lever 554 shown in FIG. 21 to be pivotally mounted on shaft 556 which is journaled in the machine bed to follow the cam 558 mounted on cam shaft 40. At the upper end cam lever 554 is connected to rod 560 which as shown in FIG. 38 is pivotally connected to the center of unloader control arm 32. The lower end of control arm 32 is connected to a spring 562 which is placed in tension by movement of the rod 560 from left to right as shown in FIG. 38. The upper end of lever arm 32 is connected to pivot 564 which in turn is mounted in carriage 566 which is slidably displaced on a slidebar 568 such that the entire assembly of arm 32 and pivot 564 may move laterally from left to right as shown in FIG. 38 for a quantity of displacement defined by the distance between the vertical tangent to the slide housing boss 570 and the surface 572 of mechanical stop pin 574. This displacement of the entire unloader arm assembly upon initial displacement of rod 560 is required to permit parts having crowned end surfaces to clear the next rearward part which moves into the chuck.

The lever 32 includes a crank portion 576, the end of which is connected by means of turn buckle rod 578 to block 580 which is part of the unloader arm 550. Accordingly, extension of the rod 560 from left to right as seen in FIG. 38 first pushes the entire crank arm assembly 32, 576 to the right and then rotates the crank in the counterclockwise direction. This rotates the unloader arm 550 in the clockwise direction as seen in FIG. 39 to swing the received parts 590 from the chuck to the discharge chute 28.

The unloader arm as seen in FIG. 39 comprises an axial stop 582, seat pads 584 on base block 586 and a pivotal spring-biased clamp member 588 which is pivotally mounted on pin 590. Accordingly, the clamp block 588 may move toward and away from the seats 584 under the control of the bias spring 592 to clamp or release the parts. The discharge chute is shown to comprise an inside rail 594 and an outside rail 596, the outside rail being slightly higher than the inside rail as shown in FIG. 39. Accordingly, when the unloader arm 550 rotates around from the chuck area to the unloader discharge chute 28, the rail 594 interferes with the spring-biased arm 588 to open the unloader and drop the part directly into the discharge chute.

Again, it will be understood that various types of unloader mechanisms may be employed and that the mechanism described immediately above is illustrative rather than limiting in character.

Bed Design

Looking now to FIGS. 31 through 34 the details of the machine bed 12 will be described.

Base 12 comprises top and bottom plates 600 and 602 of uniform size, shape and thickness maintained in parallel spaced relationship by steel front and rear panel 604 and side panels 606 and 608. Accordingly, the base 12 is essentially a closed rectangular box of extreme rigidity, the rigidity being increased by central vertical strengthening ribs 620 and diagonal ribs 622 and 624. The entire structure is welded together so as to form a rigid and thermally stable base for the grinder components. Slidebar support members 610, 612, 614, and 618 are mounted directly on the top panel 600 and extend upwardly through the coolant drain pan 626. The coolant drain pan comprises a peripheral flange 628 to prevent the escape of coolant and cutting fluid which falls into the pan from grinding operations in the wheel/workpiece area. It is clear in FIG. 32 that the front slidebar 54 fits in the notched out areas of slidebar support members 610, 614, and 618 while the rear slidebar 56 fits in the notched out areas of support members 610 and 612. The workhead support members 630 and 632 are also mounted on the top plate 600 and extend upwardly through the drain pan 626. With the pan 626 spaced from the top plate 600 of the base 12 the thermal transfer between the coolant and the base is minimized. This also contributes to the thermal stability of the base construction.

Sequence Definition

Looking now to FIGS. 22, 24, 25, 40, 41, 42 and 45, the description of the sequence of operation as well as certain miscellaneous mechanical details of the grinder 10 will be described.

A typical internal grind operation is shown in FIG. 40 to involve the dress of a new grinding wheel 18 using the diamond dresser 700 which is lowered into position by rotation of the cam shaft 40 and the cam 702 which is mounted thereon. Cam follower lever 704 which is pivotally mounted on the machine base and which has the upper end thereof connected to control rod 706 (FIG. 22) lowers the dresser motor 33 into the dress position. Once the wheel is dressed, the dresser 33 is rotated out of the dress position and the wheel is inserted into the part for the initial grind operation. The wheel 18 is then withdrawn, dressed, having been compensated in lateral position for reduction in diameter, and reinserted into the part. The wheel is then indexed over laterally into engagement with the part for the final grind operation. The wheel is axially oscillated during the finish grind as previously described to produce a fine finish grind. The wheel is withdrawn and the part is ejected and carried to the discharge chute and the sequence repeats.

Sequencer Operation

Figure 45:
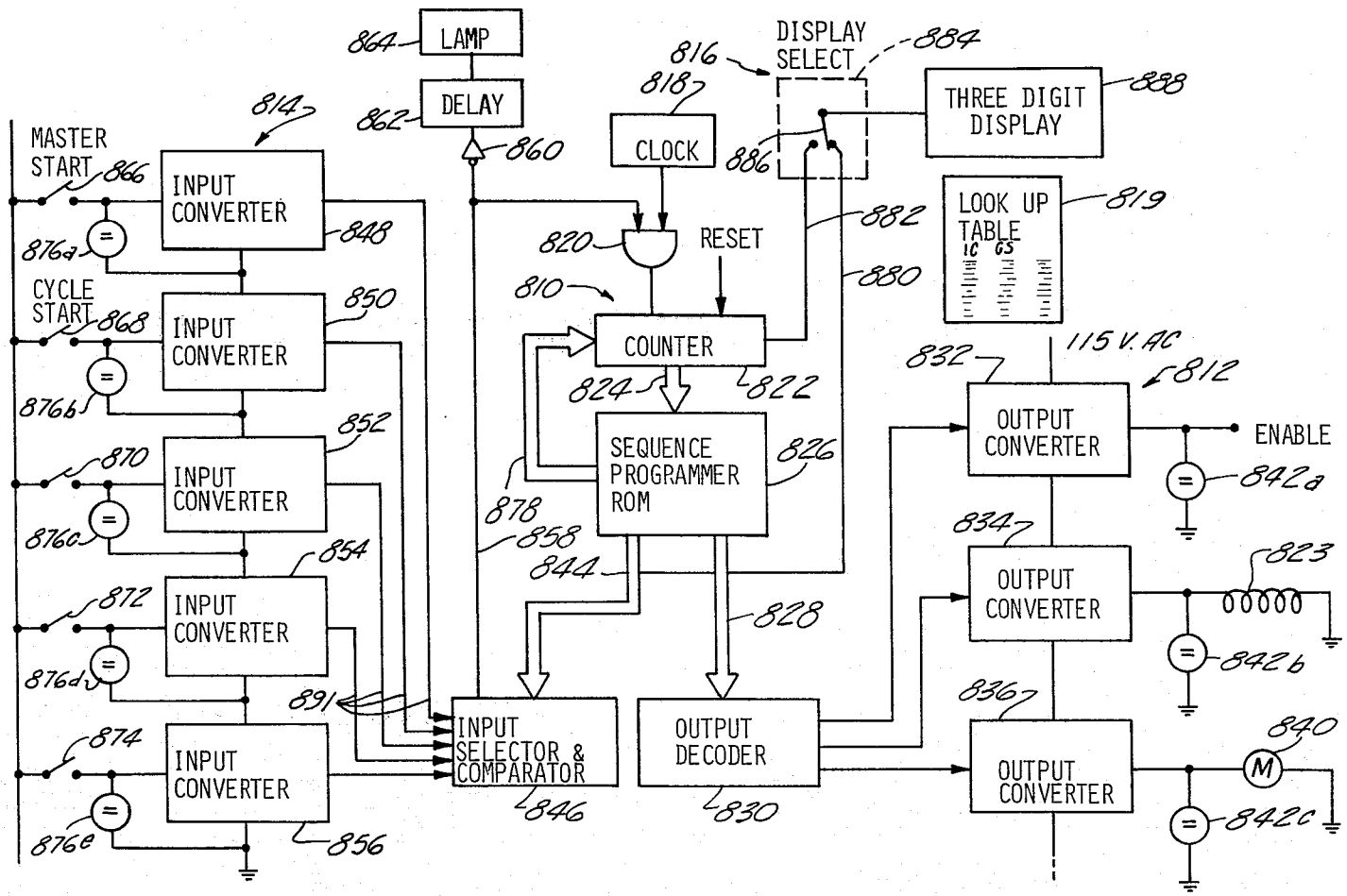
FIG. 45 is a block diagram of a sequencer and diagnostic display system used with the grinder of FIG. 1.

The sequence controller of FIG. 45 comprises a sequence command section 810 which generates several classes of digitally coded control signal sequences defining the specific control and analysis steps to be performed in the course of the grinding operation. The sequence controller further comprises an output section 812 which is connected to receive a sequence of output codes representing specific machine functions to be actuated and to perform those functions by way of specific output function generators. The sequence controller further comprises an input signal generator section 814 which responds to the performance of specific machine functions to produce signals representing performance or nonperformance, as the case may be, and for transmitting these signals back to the sequence control section 810 to control the advance of the sequence; i.e., the sequence is advanced only as long as the required functions designed by the output code signals are being performed in a timely and proper fashion. The sequence controller further comprises a display section 816 which provides specific advisories to an operator regarding functions to be performed and which further provides diagnostic information in the event of a malfunction.

The sequence control section 810 comprises a fixed frequency clock 818 to provide basic timing signals. Clock 818 is connected through a coincidence gate 820 to an ordinary digital counter 822 to advance the counter at the clock rate but only if the machine functions being called for are performed. The counter 822 produces on the output bus 824 thereof a parallel digital representation hereinafter referred to as a cycle step command, these commands representing the specific machine cycle steps which are to be executed in a sequential fashion. Typically the counter is advanced digitally from 000 to 001, 002, 003, and so forth in a numerically sequential fashion. It is possible, however, as hereinafter described for the counter 822 to jump to certain specified subroutines having digital cycle step commands which are numerically nonsequential; i.e., out of numerical order with respect to the cycle step commands just previously being executed. Following such a numerically non-sequential subroutine, counter 822 jumps back to the sequential numerical order to be advanced by clock 818 as the commanded cycle steps are performed.

Output bus 824 of counter 822 is connected to a sequence programmer 826 which may be implemented in the form of a electronic read-only memory. The sequence programmer 826 responds to the numerical cycle step commands from the counter 822 to generate a numerically more complex sequence of specific codes including a sequence of output codes each of which is applied in parallel by way of multiconductor bus 828 to an output decoder 830. The function of the output decoder is to decode the multibit output codes received from the sequence programmer 826 and to select for actuation one of the several output channels represented in FIG. 45 by output converters 832, 834, and 836. It is to be understood that many more than three output channels are found in the typical controlled machine since there are more than three controlled machine functions. The output converters 832, 834, and 836 function to increase the electrical signal power level from the output decoder 830 to a higher power level for actuation of an output function controller, such as solenoid coil 838 or motor 840.

The output converters are more fully described in a previously issued U.S. Pat. No. 3,719,931 to Roger L. Schroeder. Each of the output converters 832, 834, and 836 has associated therewith a small neon lamp 842*a*, 842*b*, and 842*c*, respectively, which is lighted as the output converter associated therewith is selected for actuation by the output decoder 830. As hereinafter described, the output converter electronics are typically placed on a single circuit board along with the associated neon lamp 842 so that at any time the lighted or unlighted state of the neon lamp represents the actuated or non-actuated state of the associated output converter.

Sequence programmer 826 further produces a sequence of input codes which are applied by way of bus 844 to the input selector portion of comparator 846. The input codes may be thought of as generalized machine function advisories which are produced in an intermittent fashion, many input codes being immediately followed by a subsection of one or more numerical cycle step commands representing specific machine steps to be executed within the broad category or subroutine represented by the initial input code. The encoder portion of encoder comparator 846 is connected to receive input signals representing the status of certain machine functions from input section 814. This section comprises a plurality of power step-down devices in the form of input converters 848, 850, 852, 854, and 856. Whereas the output converters of section 812 are typically employed to step up from a 5-volt D.C. logic level to a 115-volt A.C. power lever, the input converters of section 814 are used to step down from the 115-volt A.C. level to the 5-volt input logic level. These numbers are given purely by way of example.

Each input converter in section 814 has associated therewith a signal generating device, such as hard contact push-button switches 866 and 868 and hard contact limit switches 870, 872, and 874. In the embodiment of of FIG. 45, push-button switch 866 is a "master start" switch which, through input converter 848, is capable of satisfying one of the early running conditions in any typical grinding operation. Switch 868 is shown in FIG. 45 as a "cycle start" button and, in accordance with the program of sequence programmer 826, must typically be depressed to restart any sequence of part production. Switches 870, 872, and 874 may be taken as representative of machine element position measuring limit switches, rotation switches, speed sensors, pressure sensors, etc. Each input converter 848, 850, 852, 854, and 856 has associated therewith a small neon indicator lamp 876*a*, 876*b*, 876*c*, and 876*e*, respectively, indicating the actuated or nonactuated status of the input channel represented by the associated input converter. Again, the specific nature of the input converters in section 814 are more fully described in U.S. Pat. No. 3,719,931. All of the input converters are connected via lines 891 to the encoder-comparator 846.

As previously described, a sequence programmer 826 produces a sequence to input codes which are presented to the input selector portion of comparator 846 to represent a sequence of machine function requirements which are being called for at given times. Conversely, the signals produced by the input converters 848, 850, 852, 854, and 856 are applied to the input selector portion of encoder comparator 846 where they represent the machine functions that are actually met; i.e., executed in or by the machine. The input code from programmer 826 is compared to the "requirements met" code from the encoder and, if the signals match to indicate that the required functions have been performed, an "advance" signal is produced on line 858 and applied to the coincidence gate 820 to advance the counter 822 upon the occurrence of the next clock signal from clock 818. In this fashion, the entire sequence is advanced only as the functions required are met. If no advance signal appears on line 858 for a predetermined time, the signal applied to a delay device 862 through an inverter 860 lights a lamp 864 which may be located on the machine to signal the fact that the machine requires attention. Delay 862 may be a suitably timed monostable multivibrator or "one-shot" device.

Sequence programmer 826 generates not only the output codes on line 828 and the input codes on lines 844, but also a subroutine address code on line 878 in the form of a sequence of cycle step commands which are applied to the counter 82 whenever it is necessary or desirable to execute a subroutine having cycle step commands which are out of the normal numerical sequence generated by the signals from clock 818. As is more fully described with reference to copending application Ser. No. 465,334, now U.S. Pat. No. 3,939,453, filed concurrently herewith, counter 822 is capable of temporarily storing the last generated numerically sequential cycle step command while the subroutine cycle step commands are generated and executed. The last generated numerical cycle step command is then retrieved from temporary storage, incremented by one, and placed back in the main counter portion for ongoing sequence control. The subroutine cycle step commands appear on line 878 which is connected between the programmer 826 and the counter 822.

Looking now to the display section 816, the input codes are applied by way of line 880 and the cycle step commands are applied by way of line 882 to a display select switch 884 which typically comprises a spring-biased push-button 886 biased in such a direction as to normally transmit the input code signals on line 880 to a three-digit, numerical display unit 888. The unit 888 may take a variety of forms including Nixie tubes, liquid crystal displays, cathode ray tube display, and so forth. Its function is to display in three digits a coded representation of the input codes as they are generated and applied by the sequence programmer 826 to the comparator 846. The three-digit display 888 is typically used by the operator in conjunction with a look-up table 819 which may take the form of one or more sheets of listed input codes and advisories which more fully explain the significance and/or functions required in connection with the input codes generated by the three-digit display 888. The display select switch 884 may be moved by manually depressing the push-button 886 over to the terminal contact of the cycle step command line 882 to display the more specific cycle step commands generated in sequence following the typical input code. Accordingly, the three-digital display device 888 is capable of presenting advisories in a two-level mode, the input codes presenting general information and the cycle step command codes present specific information regarding the actual machine function which is being performed or which should be performed at a given time. In any event, the display 888 presents the last generated code, whether it be an input code or a cycle step command; therefore, upon occurrence of a code sequence interruption, the last presented code represents the function which is either being performed or should be performed by the grinder machine. If the last presented input code does not fully advise the operator of his diagnosis, repair, or progress steps, he switches to the cycle step command for more specific information.

Summarizing, it can be seen that the sequence control section 810 produces a sequence in the read-only memory programmer 826 to (1) direct the machine to execute specific functions by way of the output section 812, (2) compare input codes to signals which are generated by the actual performance of machine functions, as indicated by signals from section 814, (3) advance the sequence, if the input codes from programmer 826 compare to the input codes from the input section 814, and (4) display the status of the machine functions and machine function commands at all times by way of the three-digit display 888.

Miscellaneous Details

Figure 42:
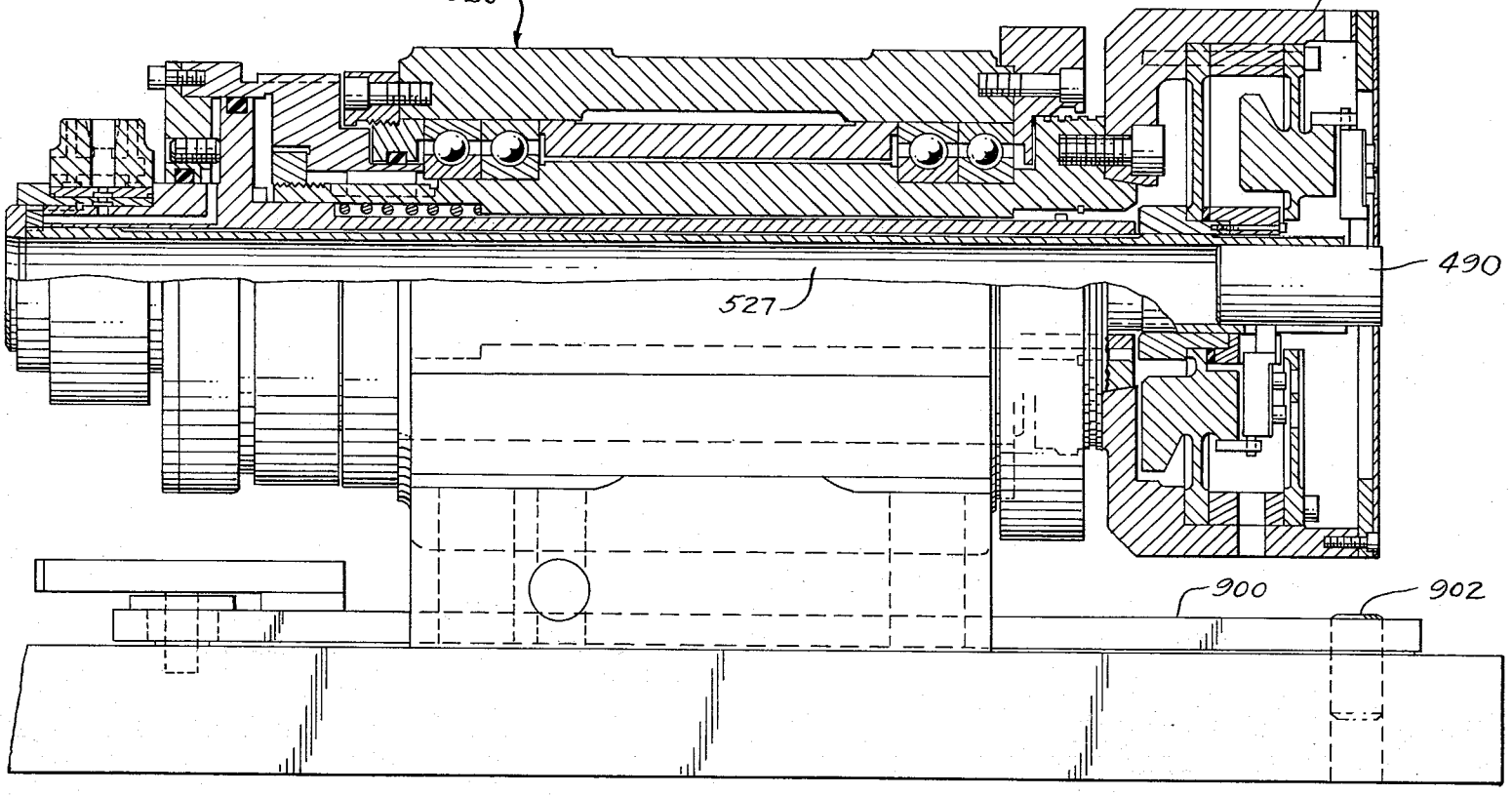
FIG. 42 is a side view in section of the workhead.

FIGS. 41 and 42 illustrate an apparatus feature by which the workhead assembly 20 may be adjusted in position relative to base 12 to compensate for any non-alignment between the workhead axis and the axis of the grinding wheel. In FIGS. 41 and 42 the workhead motor 526 which drives the chuck 524 is mounted on a sub-base 900 which in turn is bolted to base supports 630 and 632. The workhead 526 is pivotal reltative to sub-base 900 about pin 902 as threaded adjustment rod 904 is turned in block 906. Accordingly, any skew in the chuck orientation which might affect the ground surface can be easily corrected.

Figure 44:
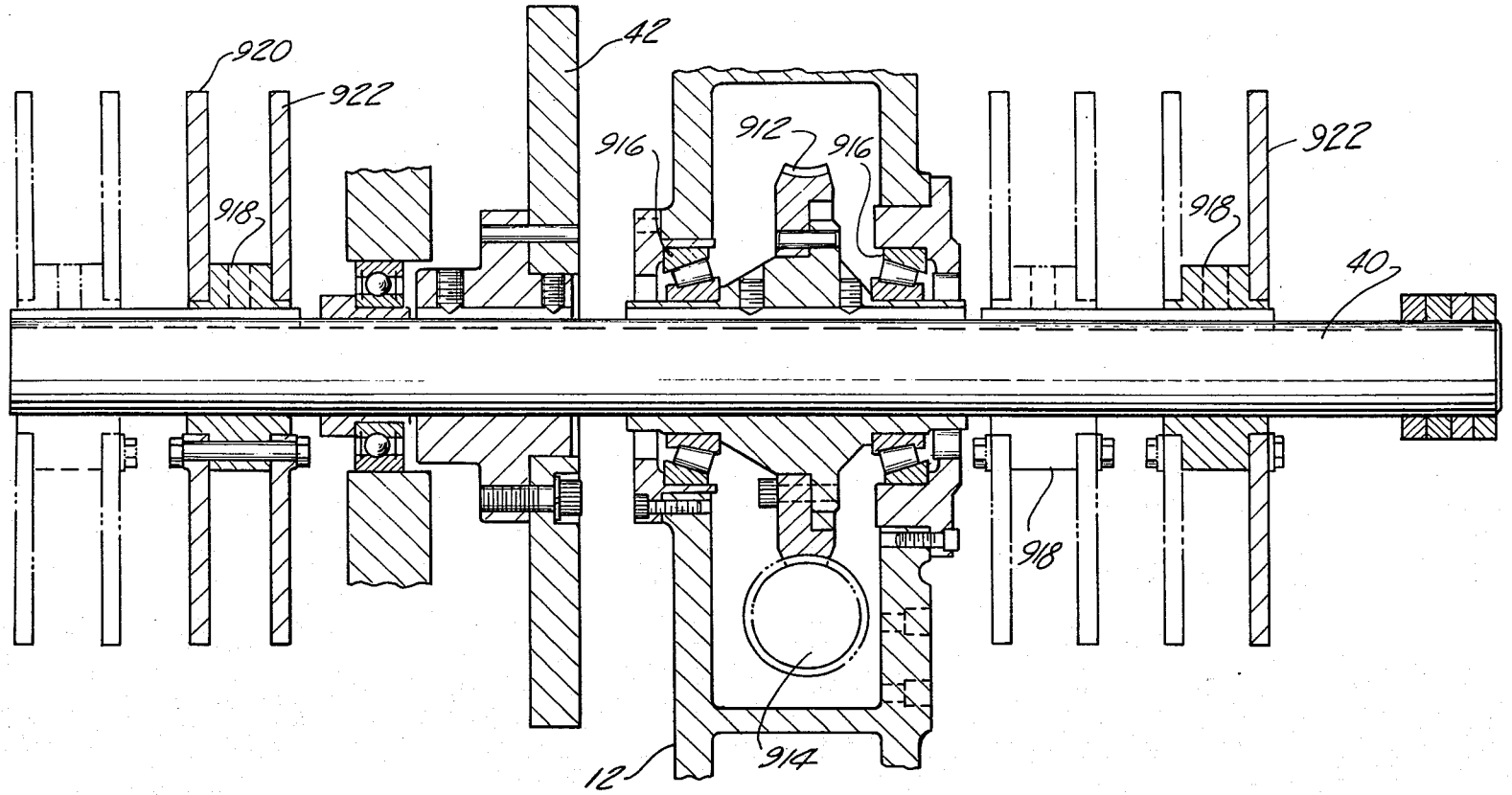
FIG. 44 is a sectional view of the programming cam shaft.

FIG. 44 illustrates a preferred form of the main programming cam shaft 40 mounted in base 12. Shaft 40 is mounted for rotation in bearings 916 and carries centrally thereof a worm gear 912. Gear 912 meshes with worm shaft 914 which is driven by one or the other of the main drive motors 36 and 44. The gear 912 is straddled by tapered roller bearings 916 which support the center of the shaft 40 for rotation relative to base 12. To the left and right of bearings 916 are mounted clamp-on cam adaptions 918 bearing cams 920, 922, etc. By this apparatus, additional causes may be added to the assembly to accommodate the programming of various devices. Main cam 42 is also shown.

It is to be understood that the invention has been described with reference to an illustrative embodiment and that various design and configurational changes as well as functional changes may be made to the apparatus illustrated without departing from the spirit and scope of the subject invention; for example, the invention may be employed in a machine having external and face grinding capabilities as well as for various other metal working operations.

The embodiments of the invention in which an exclusive property or privilege is claimed are defined as follows:

1. In a metal working machine having a base and a slide assembly mounted on the base for displacement relative thereto, apparatus for selectively producing a reciprocating motion of the slide assembly relative to the base and comprising:

an eccentric cam mounted on the base for rotation relative thereto and having a peripheral contact surface defining a contact point having a reciprocating motion, said eccentric cam being spaced from the slide assembly, bias means for urging the slide assembly in a first longitudinal direction relative to the base, an oscillator lever having a fixed end pivotally mounted on the base and a free end engaging the peripheral contact surface of the eccentric cam for continuous pivotal movement as the cam is rotated, spacer means selectively insertable between the oscillator lever and the slide assembly for mechanically coupling the oscillator lever and the slide assembly to reciprocate the slide assembly in accordance with rotation of the cam, power means connected to the spacer means for selectively displacing the spacer into position between the oscillator lever and the slide assembly, said power means including adjustment means for selectively varying the point of contact between the spacer means and the oscillator lever along the length of the oscillator lever between the fixed end and the free end thereby to vary the degree of reciprocating displacement transferred from the cam to the slide assembly.

2. Apparatus as defined in claim 1 wherein the cam is continuously driven.

3. Apparatus as defined in claim 1 wherein the power means comprises a fluid cylinder mounted on the base and having an extensible output shaft, the spacer comprising a rigid member pivotally connected to the end of the extensible output shaft and freely pivotally positionable between the slide assembly and the oscillator lever, bias means for urging one end of the spacer into engagement with the slide assembly whenever the fluid cylinder is actuated, and roller means carried by the spacer and engaging the oscillator lever.

4. Apparatus as defined in claim 3 wherein the oscillator lever is arcuate in configuration and comprises a roller track extending between the fixed end and the free end, said roller means carried by the spacer being disposed in the roller track.

5. Apparatus as defined in claim 3 including a spring connected between the base and the end of the spacer proximate the oscillator lever such that operation of the fluid cylinder is effective to seat the spacer against the slide assembly before seating the roller relative to the oscillator lever.

* * * * *